US008991067B2

(12) United States Patent
Zielinski et al.

(10) Patent No.: US 8,991,067 B2
(45) Date of Patent: Mar. 31, 2015

(54) METHODS AND APPARATUSES FOR DRYING ELECTRONIC DEVICES

(71) Applicant: Revive Electronics, LLC, Fishers, IN (US)

(72) Inventors: Reuben Quincey Zielinski, Fishers, IN (US); Joel Christopher Trusty, Fishers, IN (US)

(73) Assignee: Revive Electronics, LLC, Carmel, IN (US)

( * ) Notice: Subject to any disclaimer, the term of this patent is extended or adjusted under 35 U.S.C. 154(b) by 0 days.

(21) Appl. No.: 13/756,879

(22) Filed: Feb. 1, 2013

(65) Prior Publication Data

US 2013/0192083 A1 Aug. 1, 2013

Related U.S. Application Data

(60) Provisional application No. 61/593,617, filed on Feb. 1, 2012, provisional application No. 61/638,599, filed on Apr. 26, 2012.

(51) Int. Cl.

| | |
|---|---|
| ***F26B 3/00*** | (2006.01) |
| ***F26B 5/04*** | (2006.01) |
| *F26B 9/00* | (2006.01) |

(52) U.S. Cl.

CPC ... *F26B 3/00* (2013.01); *F26B 5/04* (2013.01); *F26B 5/044* (2013.01); *F26B 9/003* (2013.01)

USPC ..... 34/403

(58) Field of Classification Search

CPC ..... F26B 3/00; F26B 3/18; F26B 3/20; F26B 5/04; F26B 9/006; F26B 21/04; F26B 21/06; F26B 21/083; F26B 23/022; C10F 5/00; C23C 14/564; H01L 21/67028

USPC ..... 34/402, 403, 405–408, 412, 413, 467, 34/472, 473, 474, 492

See application file for complete search history.

(56) References Cited

U.S. PATENT DOCUMENTS

| | | | |
|---|---|---|---|
| 2,496,054 | A | 1/1950 | Hoyler |
| 2,846,710 | A | 8/1958 | Haka |

(Continued)

FOREIGN PATENT DOCUMENTS

| | | | |
|---|---|---|---|
| CN | 2065321 | | 11/1990 |
| CN | 201018665 | Y * | 2/2008 |

(Continued)

OTHER PUBLICATIONS

International Search Report and Written Opinion issued in PCT/US2013/024277, pp. 1-16, May 5, 2013.

(Continued)

*Primary Examiner* — Jiping Lu

(74) *Attorney, Agent, or Firm* — Daniel L. Boots; Douglas G. Gallagher; Bingham Greenebaum Doll LLP

(57) ABSTRACT

Methods and apparatuses for drying electronic devices are disclosed. Embodiments include methods and apparatuses that heat and decrease pressure within the electronic device. Some embodiments increase and decrease pressure while adding heat. Other embodiments include a desiccator for removing moisture from the air being evacuated from the electronic device prior to the air reaching an evacuation pump. Further embodiments detect humidity within the low-pressure chamber and determine when to increase and/or decrease pressure based on the humidity. Still further embodiments determine that the device is sufficiently dry to restore proper function based on the detected humidity, and in some embodiments based on the changes in humidity while pressure is being increased and/or decreased. Still further alternate embodiments automatically control some or all aspects of the drying of the electronic device. Additional embodiment disinfect the electronic device.

30 Claims, 17 Drawing Sheets

(56) References Cited

U.S. PATENT DOCUMENTS

| | | | | |
|---|---|---|---|---|
| 3,897,604 | A | 8/1975 | Weimer | |
| 3,932,944 | A | 1/1976 | Chiba | |
| 4,020,563 | A | 5/1977 | Hoefer | |
| 4,386,471 | A | 6/1983 | Bowrey et al. | |
| 4,589,971 | A | 5/1986 | Mayeaux | |
| 4,704,805 | A | 11/1987 | Kaya et al. | |
| 4,733,428 | A | 3/1988 | Malinge et al. | |
| 4,882,851 | A * | 11/1989 | Wennerstrum et al. | 34/60 |
| 5,005,410 | A | 4/1991 | Webster et al. | |
| 5,067,251 | A | 11/1991 | Zlobinsky et al. | |
| 5,293,697 | A | 3/1994 | Kawakami | |
| 5,318,164 | A | 6/1994 | Barnes et al. | |
| 5,335,703 | A | 8/1994 | deJong | |
| 5,343,747 | A | 9/1994 | Rosen | |
| 5,349,845 | A | 9/1994 | Blom | |
| 5,456,025 | A | 10/1995 | Joiner et al. | |
| 5,578,753 | A | 11/1996 | Weiss et al. | |
| 5,625,962 | A | 5/1997 | Fleissner | |
| 5,671,546 | A | 9/1997 | Haala | |
| 5,852,879 | A | 12/1998 | Schumaier | |
| 5,889,466 | A | 3/1999 | Ferguson | |
| 5,992,049 | A | 11/1999 | Trost | |
| 6,025,580 | A | 2/2000 | Yagi | |
| 6,039,696 | A | 3/2000 | Bell | |
| 6,122,836 | A | 9/2000 | Tenedini et al. | |
| 6,399,920 | B1 * | 6/2002 | Guinn | 219/386 |
| 6,551,552 | B1 | 4/2003 | Lyublinski et al. | |
| 6,552,308 | B2 * | 4/2003 | Nishimura | 219/497 |
| 6,557,268 | B1 | 5/2003 | Berg et al. | |
| 6,568,249 | B2 | 5/2003 | Devine | |
| 6,622,399 | B1 | 9/2003 | Theriault et al. | |
| 6,675,636 | B2 | 1/2004 | Sadler | |
| 6,821,025 | B2 | 11/2004 | Gerhard | |
| 6,834,443 | B2 | 12/2004 | Bloemendaal | |
| 6,893,530 | B2 * | 5/2005 | Kishimoto et al. | 156/285 |
| 6,938,359 | B2 | 9/2005 | Birgersson et al. | |
| 7,050,837 | B2 | 5/2006 | Menz et al. | |
| 7,194,822 | B2 | 3/2007 | Kolari | |
| 7,205,900 | B2 | 4/2007 | Liu et al. | |
| 7,243,857 | B2 | 7/2007 | Kallestad | |
| 7,460,350 | B2 | 12/2008 | Talbot et al. | |
| 7,557,466 | B2 | 7/2009 | Wong et al. | |
| 7,594,343 | B2 | 9/2009 | Woerdehoff et al. | |
| 7,612,315 | B2 | 11/2009 | Corradini | |
| 7,631,538 | B2 | 12/2009 | Imhof | |
| 7,665,226 | B2 | 2/2010 | Tsuruta et al. | |
| 7,814,678 | B2 | 10/2010 | Romanek | |
| 8,058,588 | B2 | 11/2011 | Gagas et al. | |
| 8,108,074 | B2 | 1/2012 | Boder | |
| 8,112,900 | B2 | 2/2012 | Romanek | |
| 8,203,689 | B2 | 6/2012 | Gomi | |
| 8,281,499 | B2 | 10/2012 | Friesen et al. | |
| 8,355,233 | B2 | 1/2013 | Schumacher et al. | |
| 8,416,542 | B2 | 4/2013 | Nakamura | |
| 8,446,049 | B2 | 5/2013 | Lee | |
| 8,498,087 | B2 | 7/2013 | Rabu et al. | |
| 2001/0025431 | A1 * | 10/2001 | Kitano et al. | 34/406 |
| 2001/0045421 | A1 | 11/2001 | Sullivan | |
| 2003/0019124 | A1 | 1/2003 | Miyakawa et al. | |
| 2003/0115768 | A1 | 6/2003 | Hoffman | |
| 2004/0050076 | A1 | 3/2004 | Palfy et al. | |
| 2004/0079136 | A1 | 4/2004 | Pillion | |
| 2005/0079888 | A1 | 4/2005 | Menz et al. | |
| 2005/0218239 | A1 | 10/2005 | Busch | |
| 2006/0058069 | A1 | 3/2006 | Garcia et al. | |
| 2006/0208914 | A1 | 9/2006 | Liu et al. | |
| 2006/0255166 | A1 | 11/2006 | Imamura et al. | |
| 2007/0258870 | A1 | 11/2007 | Brown et al. | |
| 2008/0281528 | A1 | 11/2008 | Relle, Jr. | |
| 2009/0019718 | A1 | 1/2009 | Mittleman et al. | |
| 2009/0145783 | A1 | 6/2009 | Forker | |
| 2009/0158614 | A1 * | 6/2009 | Singh et al. | 34/474 |
| 2009/0272176 | A1 | 11/2009 | Lopez et al. | |
| 2009/0273480 | A1 | 11/2009 | Mittleman et al. | |
| 2010/0095504 | A1 | 4/2010 | Slack et al. | |
| 2010/0103566 | A1 | 4/2010 | Chen | |
| 2010/0122470 | A1 | 5/2010 | Davis et al. | |
| 2011/0047814 | A1 | 3/2011 | Watson et al. | |
| 2011/0067262 | A1 | 3/2011 | Eero | |
| 2011/0099831 | A1 | 5/2011 | Parisi et al. | |
| 2011/0137607 | A1 | 6/2011 | Hsieh | |
| 2012/0020015 | A1 | 1/2012 | Tian et al. | |
| 2012/0038374 | A1 | 2/2012 | Johnson | |
| 2012/0085324 | A1 | 4/2012 | Saito et al. | |
| 2012/0171462 | A1 | 7/2012 | Tsai | |
| 2012/0304483 | A1 | 12/2012 | Sirard et al. | |
| 2013/0088094 | A1 | 4/2013 | Paik | |
| 2013/0096375 | A1 | 4/2013 | Iyama et al. | |
| 2013/0111227 | A1 | 5/2013 | Sauerwein, Jr. | |
| 2013/0167874 | A1 | 7/2013 | Mittleman et al. | |
| 2013/0182360 | A1 | 7/2013 | Stevens et al. | |

FOREIGN PATENT DOCUMENTS

| | | |
|---|---|---|
| CN | 101986360 | 3/2011 |
| CN | 201955259 | 8/2011 |
| EP | 0539607 | 5/1993 |
| EP | 1125177 | 1/2004 |
| JP | 2001197175 | 7/2001 |
| JP | 2011171894 | 9/2011 |
| WO | 0023861 | 4/2000 |
| WO | 0053983 | 9/2000 |
| WO | 2007033493 | 3/2007 |
| WO | 2009087102 | 7/2009 |
| WO | 2010070551 | 6/2010 |

OTHER PUBLICATIONS

"How to Dry Out a Wet Cell Phone," ehow.com, http://www.ehow.com/print/how_2042819_dry-out-wet-cell-phone.html, pp. 1-2, Jun. 5, 2013 (obtained from PTO-892 form mailed by US Patent Office on Jun. 16, 2012 with respect to U.S. Appl. No. 12/459,700, which was retrieved by the Examiner on Dec. 8, 2011).

U.S. Trademark Registration No. 4,280,438 for the mark Drybox, pp. 1-2, Jan. 22, 2013.

Exhibitor News from International CTIA Wireless 2012, pp. 1-3, May 3, 2012.

Lucio, Valentino, "A Solution for Soaked Cells," San Antonio Express-News, pp. 1-3, Oct. 19, 2011.

Cooper, Sean, "Drybox Rescue Station: the ultimate cellphone drying system (hands-on)," www.engadgetcom, pp. 1-13, May 22, 2013.

Drybox The New Way to Save a Wet Phone Fast, http://www.dryboxrescue.com/, pp. 1-5, 2012.

International Search Report and Written Opinion issued in PCT/US2013/070178. Feb. 24, 2014.

International Preliminary Report on Patentability issued in PCT/US2013/024277, pp. 1-12 Aug. 8, 2014.

Final Office Action issued in U.S. Appl. No. 14/080,595. Sep. 3, 2014.

Non-Final Rejection issued in U.S. Appl. No. 14/080,595. Feb. 28, 2014.

Response After Non-Final Action filed in U.S. Appl. No. 14/080,595. May 28, 2014.

International Search Report and Written Opinion issued in PCT/US2014/028634. Aug. 27, 2014.

* cited by examiner

METHODS AND APPARATUSES FOR DRYING ELECTRONIC DEVICES

This application claims priority to U.S. Provisional Application Nos. 61/593,617, filed Feb. 1, 2012, and 61/638,599, filed Apr. 26, 2012, the entireties of which are hereby incorporated herein by reference.

FIELD

Embodiments of the present disclosure generally relate to the repair and maintenance of electronic devices, and to the repair and maintenance of electronic devices that have been rendered at least partially inoperative due to moisture intrusion.

BACKGROUND

Electronic devices are frequently manufactured using ultra-precision parts for tight fit-and-finish dimensions that are intended to keep moisture from entering the interior of the device. Many electronic devices are also manufactured to render disassembly by owners and or users difficult without rendering the device inoperable even prior to drying attempts. With the continued miniaturization of electronics and increasingly powerful computerized software applications, it is commonplace for people today to carry multiple electronic devices, such as portable electronic devices. Cell phones are currently more ubiquitous than telephone land lines, and many people, on a daily basis throughout the world, inadvertently subject these devices to unintended contact with water or other fluids. This occurs daily in, for example, bathrooms, kitchens, swimming pools, lakes, washing machines, or any other areas where various electronic devices (e.g., small, portable electronic devices) can be submerged in water or subject to high humid conditions. These electronic devices frequently have miniaturized solid-state transistorized memory for capturing and storing digitized media in the form of phone contact lists, e-mail addresses, digitized photographs, digitized music and the like.

SUMMARY

In the conventional art, difficulties currently exist in removing moisture from within an electronic device. Such devices can be heated to no avail, as the moisture within the device frequently cannot exit due to torturous paths for removal. Without complete disassembly of the electronic device and using a combination of heat and air drying, the device cannot be properly dried once it is subjected to water and/or other wetting agents or fluids. Moreover, if general heating is employed to dry the device and the heat exceeds the recommended maximums of the electronics or other components, damage can occur, the device may become inoperable, and the owner's digitized data can be forever lost. It was realized that a new type of drying system is needed to allow individuals and repair shops to dry electronic devices without disassembly, while retaining the digitized data and/or while saving the electronic device altogether from corrosion.

Embodiments of the present invention relate to equipment and methods for vacuum-pressure drying of materials based on lowering the vapor pressure and the boiling points of liquids. More particularly, certain embodiments of the invention relate to a vacuum chamber with a heated platen that can be automatically controlled to heat electronics, such as an inoperable portable electronic device, via conduction, thereby reducing the overall vapor pressure temperature for the purposes of drying the device and rendering it operable again.

In certain embodiments, a platen that is electrically heated provides heat conduction to the portable electronic device that has been subjected to water or other unintended wetting agent(s). This heated platen can form the base of a vacuum chamber from which air is selectively evacuated. The heated conductive platen can raise the overall temperature of the wetted device through physical contact and the material heat transfer coefficient. The heated conductive platen, being housed in a convective box, radiates heat and can heat other portions of the vacuum chamber (e.g., the outside of the vacuum chamber) for simultaneous convection heating. The pressure within the vacuum chamber housing that contains the wetted electronic device can be simultaneously decreased. The decreased pressure provides an environment whereby liquid vapor pressures can be reduced, allowing lower boiling points of any liquid or wetting agent within the chamber. The combination of a heated path (e.g., a heated conductive path) to the wet electronic device and decreased pressure, results in a vapor pressure phase where wetting agents and liquids are "boiled off" in the form of a gas at lower temperatures thereby preventing damage to the electronics while drying. This drying occurs because the vaporization of the liquids into gasses can more easily escape through the tight enclosures of the electronic device and through the torturous paths established in the design and manufacture of the device. The water or wetting agent is essentially boiled off over time into a gas and thereafter evacuated from within the chamber housing.

Other embodiments include a vacuum chamber with a heated platen under automatic control. The vacuum chamber is controlled by microprocessor using various heat and vacuum pressure profiles for various electronic devices. This example heated vacuum system provides a local condition to the electronic device that has been wetted and reduces the overall vapor pressure point, allowing the wetting agents to boil off at a much lower temperature. This allows the complete drying of the electronic device without damage to the device itself from excessive (high) temperatures.

Certain features of the present invention address these and other needs and provide other important advantages.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein is not necessarily intended to address every object described herein, and each embodiment does not necessarily include each feature described. Other forms, embodiments, objects, advantages, benefits, features, and aspects of the present invention will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example only, and are not to be construed as limiting the scope of this invention.

DESCRIPTION OF THE ILLUSTRATED EMBODIMENTS

Figure 1:
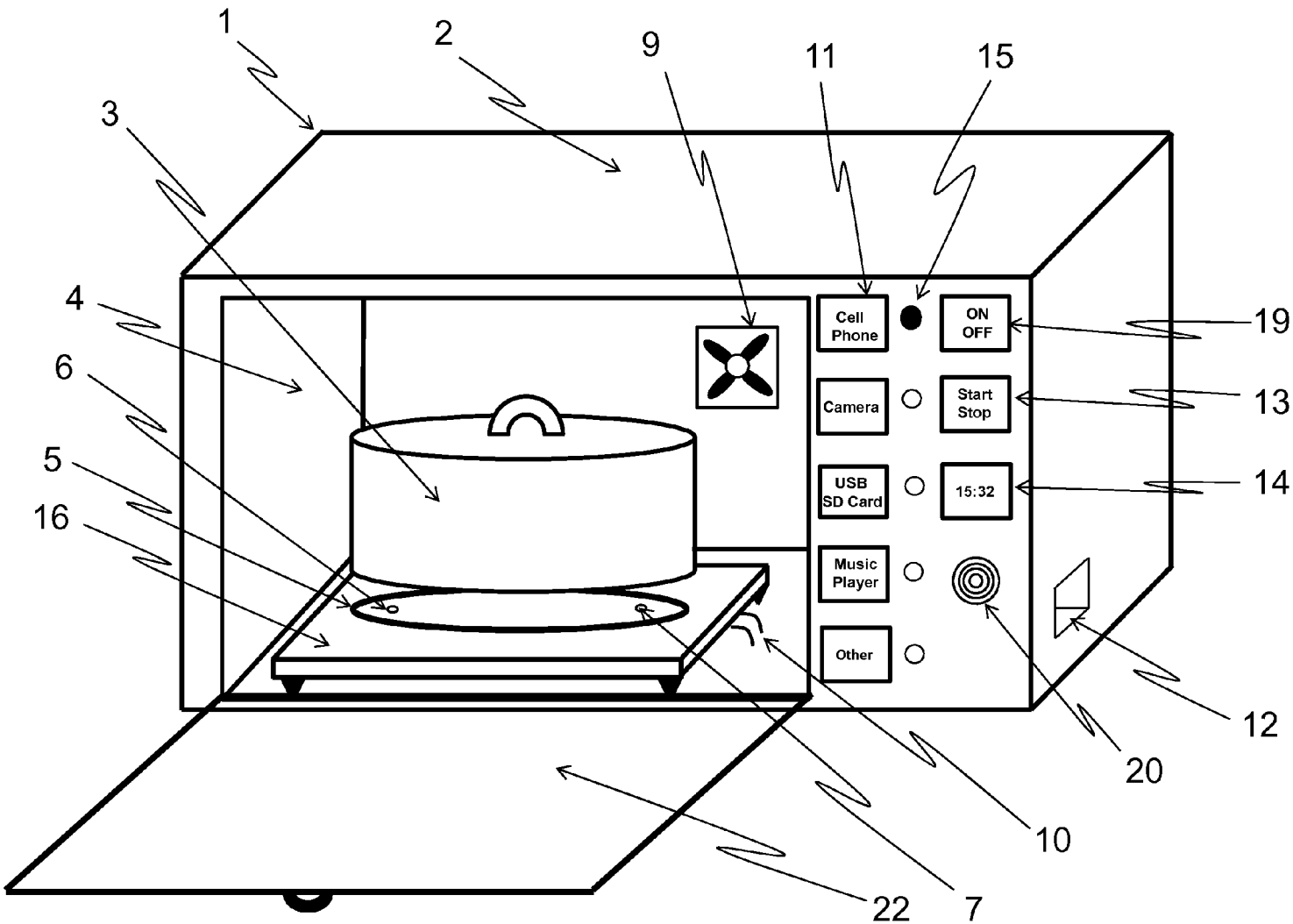
FIG. 1 is an isometric view of an electronic device drying apparatus according to one embodiment of the present disclosure.

For the purposes of promoting an understanding of the principles of the invention, reference will now be made to selected embodiments illustrated in the drawings and specific language will be used to describe the same. It will nevertheless be understood that no limitation of the scope of the invention is thereby intended; any alterations and further modifications of the described or illustrated embodiments, and any further applications of the principles of the invention as illustrated herein are contemplated as would normally occur to one skilled in the art to which the invention relates. At least one embodiment of the invention is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to "advantages" provided by some embodiments of the present invention, other embodiments may not include those same advantages, or may include different advantages. Any advantages described herein are not to be construed as limiting to any of the claims.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein, such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Embodiments of the present disclosure include devices and equipment generally used for drying materials using reduced pressure. Embodiments include methods and apparatuses for drying (e.g., automatic drying) of electronic devices (e.g., portable electronic devices such as cell phones, digital music players, watches, pagers, cameras, tablet computers and the like) after these units have been subjected to water, high humidity conditions, or other unintended deleterious wetting agents that renders such devices inoperable. At least one embodiment provides a heated platen (e.g., a user controlled heated platen) under vacuum that heats the portable electronic device and/or lowers the pressure to evaporate unwanted liquids at lower than atmospheric boiling points. The heat may also be applied through other means, such as heating other components of the vacuum chamber or the gas (e.g., air) within the vacuum chamber. The heat and vacuum may be applied sequentially, simultaneously, or in various combinations of sequential and simultaneous operation.

The evaporation point of the liquid present within the device is lowered based upon the materials of construction of the device being heated such that temperature excursions do not exceed the melting points and/or glass transition temperatures of such materials. Thus, the device being subjected to the drying cycle under vacuum pressure can be safely dried and rendered functional again without damage to the device itself.

Referring first to FIG. 1, an isometric diagram of a drying apparatus, e.g., an automatic portable electronic device drying apparatus 1, according to one embodiment of the present invention is shown. Electronic device drying apparatus 1 includes enclosure 2, vacuum chamber 3, a heater (e.g., electrically heated conduction platen 16), an optional convection chamber 4, and an optional modem Internet interface connector 12. An optional user interface for the electronic device drying apparatus 1 may be used, and may optionally be comprised of one or more of the following: input device selection switches 11, device selection indicator lights 15, timer display 14, power switch 19, start-stop switch 13, and audible indicator 20. Vacuum chamber 3 may be fabricated of, for example, a polymer plastic, glass, or metal, with suitable thickness and geometry to withstand a vacuum (decreased pressure). Vacuum chamber 3 can be fabricated out of any material that is at least structurally rigid enough to withstand vacuum pressures and to maintain vacuum pressures within the structure, e.g., is sufficiently nonporous.

Heated conduction platen 16 may be electrically powered through heater power wires 10 and may be fabricated from thermally conductive material and made of suitable thickness to support high vacuum. In some embodiments, the electrically heated conduction platen 16 is made of aluminum, although other embodiments include platens made from copper, steel, iron or other thermally conductive material, including but not limited to other metallic, plastic or ceramic material. Heated conduction platen 16 can be mounted inside of convection chamber 4 and mated with vacuum chamber 3 using, for example, an optional sealing O-ring 5. Air within vacuum chamber 3 is evacuated via evacuation port 7 and vented via venting port 6. Convection chamber 4, if utilized, can include fan 9 to circulate warm air within the convection chamber 4.

Figure 2:
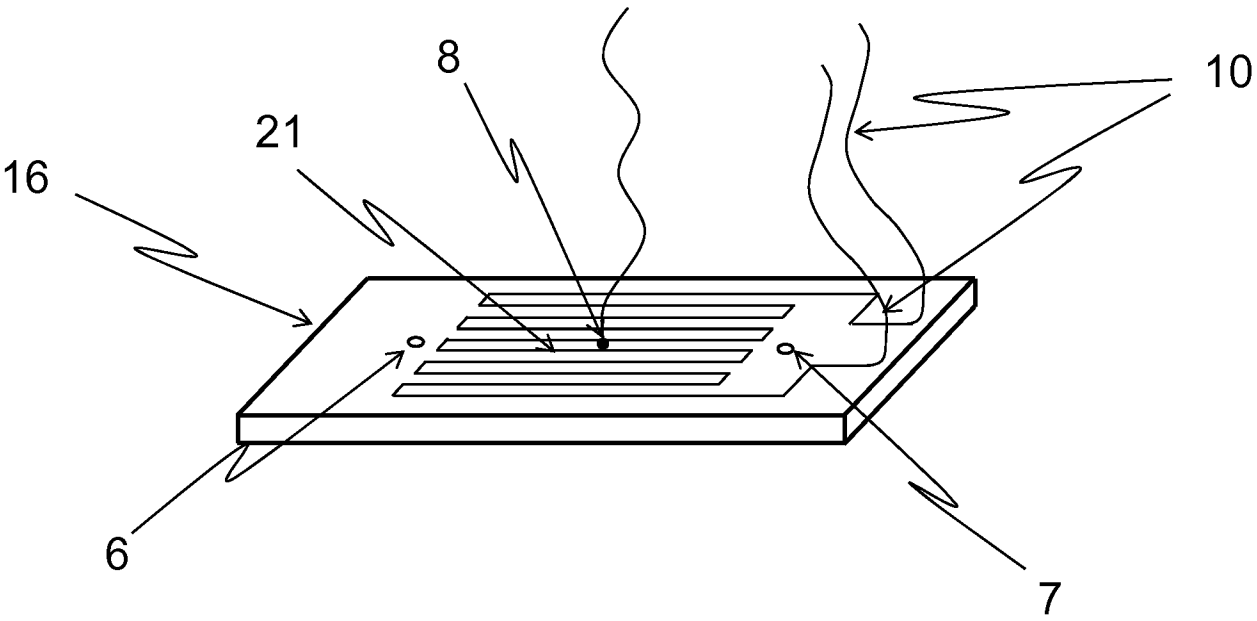
FIG. 2 is an isometric bottom view of the electrically heated conduction platen element of the electronic device drying apparatus depicted in FIG. 1.

FIG. 2 depicts heated conduction platen 16 with a heat generator (e.g., a thermofoil resistance heater 21). Heated conduction platen 16 may also include temperature feedback sensor 8, thermofoil resistance heater power connections 10, evacuation port 7, and/or venting port 6. In one embodiment of the invention, heated conduction platen 16 is a stand-alone separate heating platen sitting on a vacuum chamber mounting plate.

Figure 3:
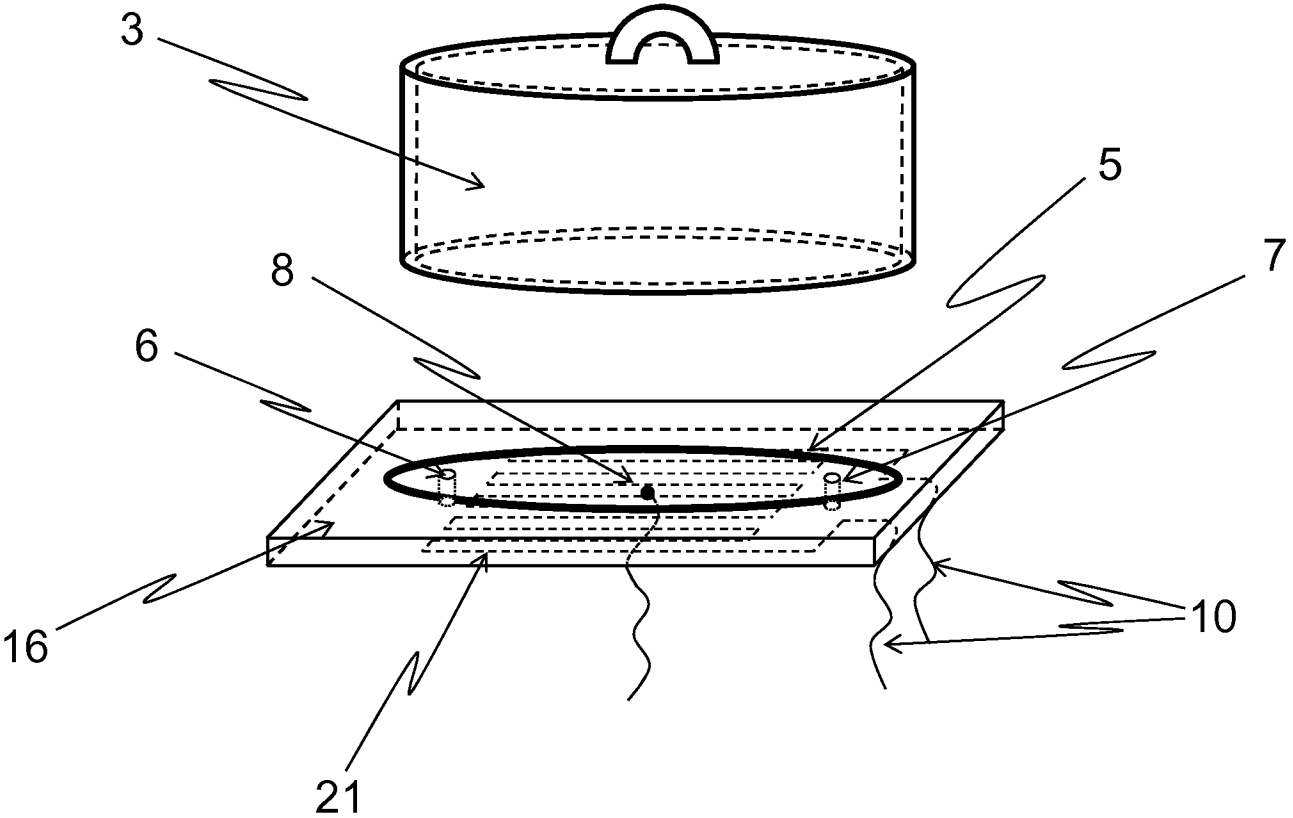
FIG. 3 is an isometric cut-away view of the electrically heated conduction platen element and vacuum chamber depicted in FIG. 1.

FIG. 3 depicts the heated conduction platen 16 and vacuum chamber 3 in a cut-away isometric view. Vacuum chamber 3 is mated to heated conduction platen 16 using sealing O-ring 5. Platen 16 provides heat energy both internally and externally to the vacuum chamber 3 via thermofoil resistance heater 21 attached to the bottom of platen 16, and is temperature-controlled by temperature feedback sensor 8. Temperature feedback sensor 8 could be a thermistor, a semiconductor temperature sensor, or any one of a number of thermocouple types. Evacuation port 7 and venting port 6 are depicted as through-holes to facilitate pneumatic connection to the interior of vacuum chamber 3 using the bottom side of the heated conduction platen 16.

Figures 4A, 4B:
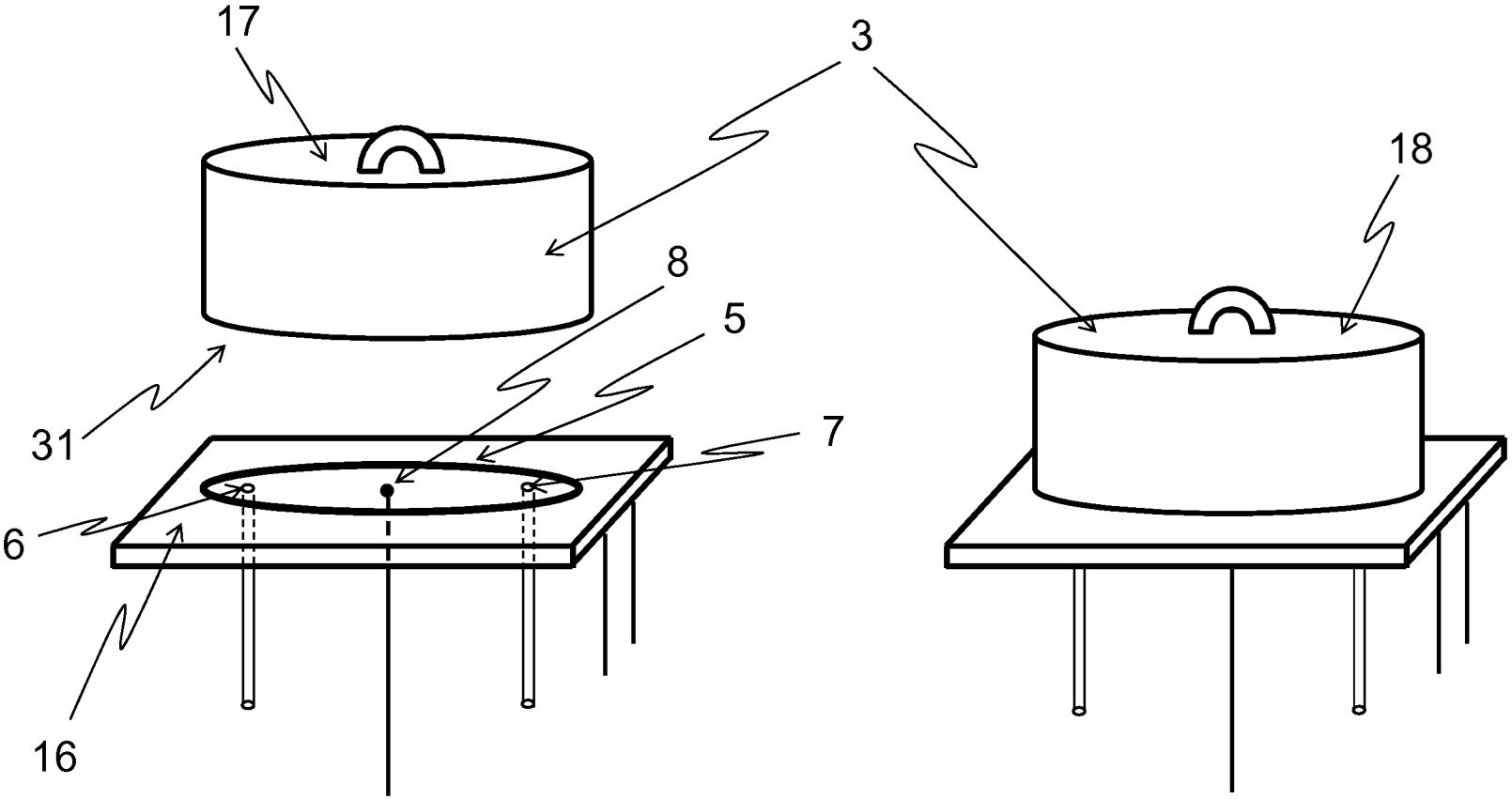
FIG. 4A is an isometric view of the electrically heated conduction platen element and vacuum chamber of FIG. 1 in the open position.
FIG. 4B is an isometric view of the electrically heated conduction platen element and vacuum chamber of FIG. 1 in the closed position.

FIGS. 4A and 4B depicts the vacuum chamber 3 in the open state 17 and closed state 18. Sealing O-ring 5 mates with vacuum chamber sealing surface 31 when transitioning from open state 17 to closed state 18. During closed state 18, evacuation port 7 and atmospheric vent port 6 are sealed inside vacuum chamber 3 by virtue of being disposed within the diameter of sealing O-ring 5.

Figure 5:
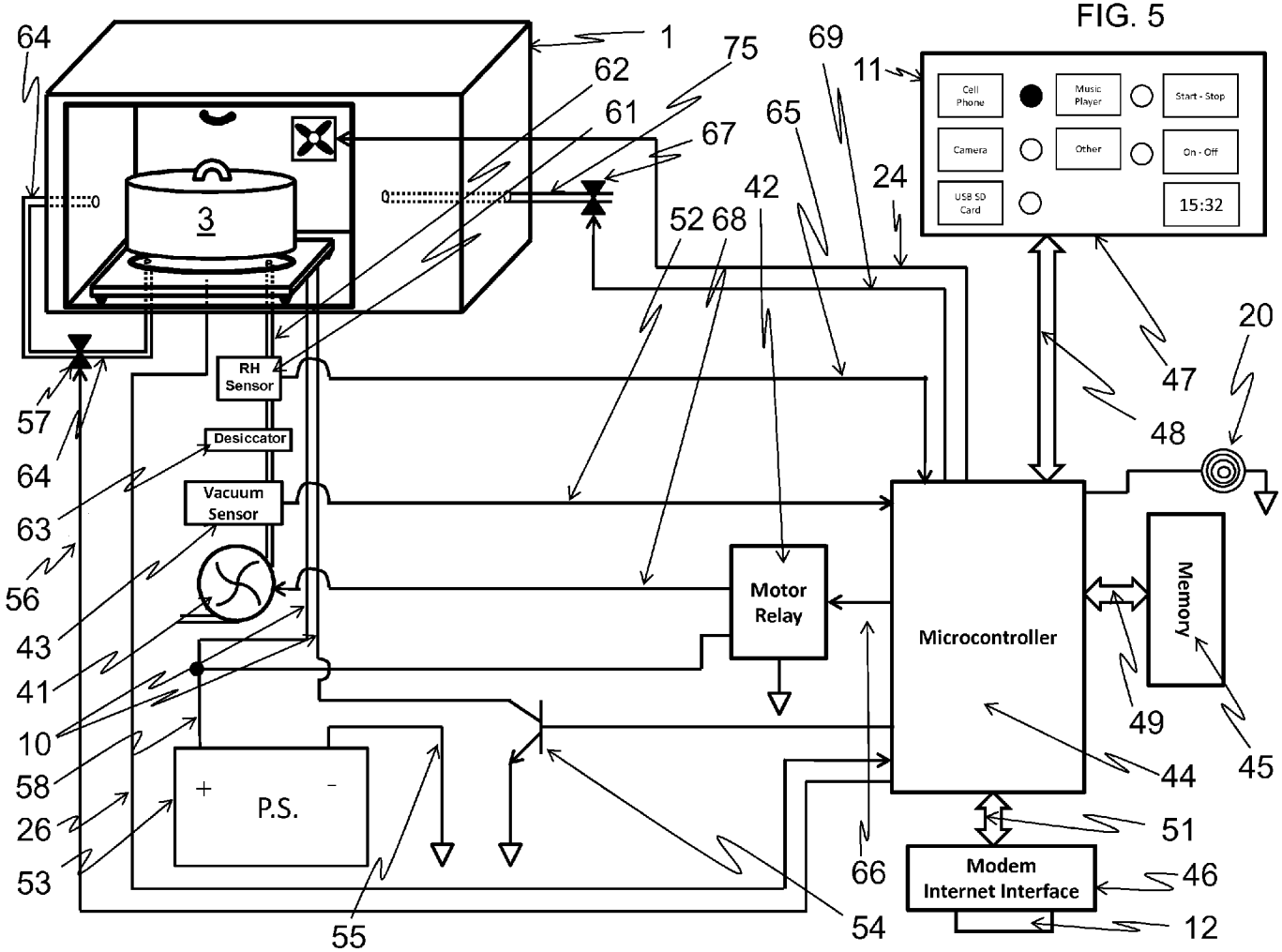
FIG. 5 is a block diagram depicting an electronics control system and electronic device drying apparatus according to one embodiment of the present disclosure.

Referring to FIG. 5, electronic device drying apparatus enclosure 1 is shown in an isometric view with control schematic in block diagram form according to one embodiment of the present invention. A controller, for example microprocessor 44, is electrically connected to user interface 47, memory 45, modem internet interface circuit 46, and evacuation pump relay 42 via user interface buss 48, memory interface buss 49, modem internet interface buss 51 and evacuation pump relay control line 66, respectively. Power supply 53 powers the entire system through, for example, positive power line 58 and negative ground line 55. Thermofoil resistance heater power lines 10 are directly connected to positive power line 58 and negative power line 55 through heater platen control transistor 54. Evacuation manifold 62 is connected to evacuation pump 41, which is electrically controlled via evacuation pump control line 68. Vacuum pressure sensor 43 is connected to evacuation manifold 62 and produces vacuum pressure level signals via vacuum pressure sensor signal wire 52. A relative humidity sensor 61 may be pneumatically connected to evacuation manifold 62 and can produce analog voltage signals that relate to the evacuation manifold 62 relative humidity. Analog voltage signals are sensed by relative humidity signal wire 61 to control microprocessor 44. Convection chamber vent solenoid 57 is connected to convection chamber vent manifold 64 and is controlled by control microprocessor 44 via convection chamber solenoid vent valve control signal 56. Atmospheric vent solenoid valve 67 is connected to atmospheric vent manifold 75 and is controlled by control microprocessor 44 via atmospheric solenoid vent valve control signal wire 69.

Figure 6A:
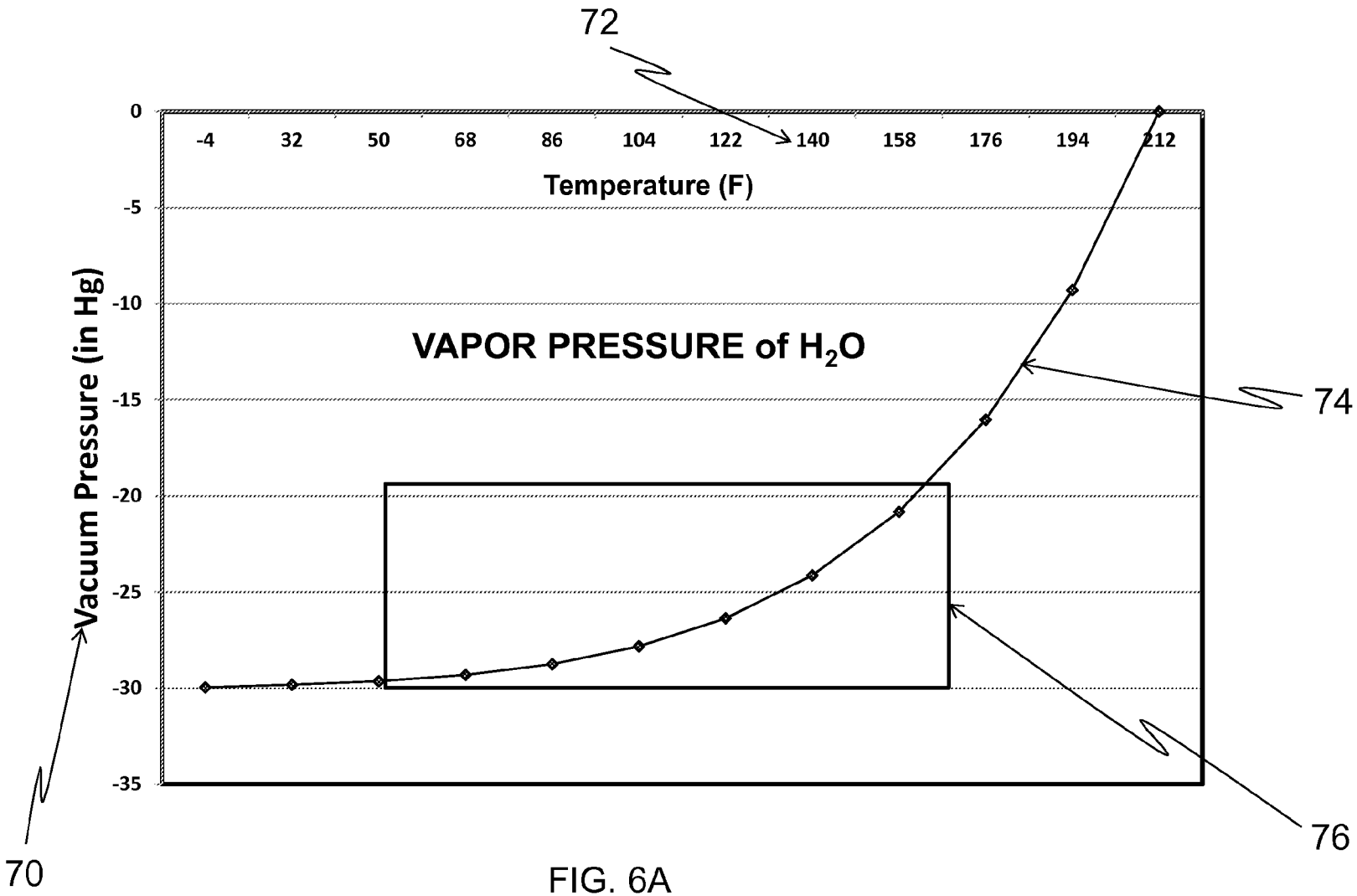
FIG. 6A is a graphical representation of the vapor pressure curve of water at various vacuum pressures and temperatures and a target heating and evacuation drying zone according to one embodiment of the present disclosure.
Figure 6B:
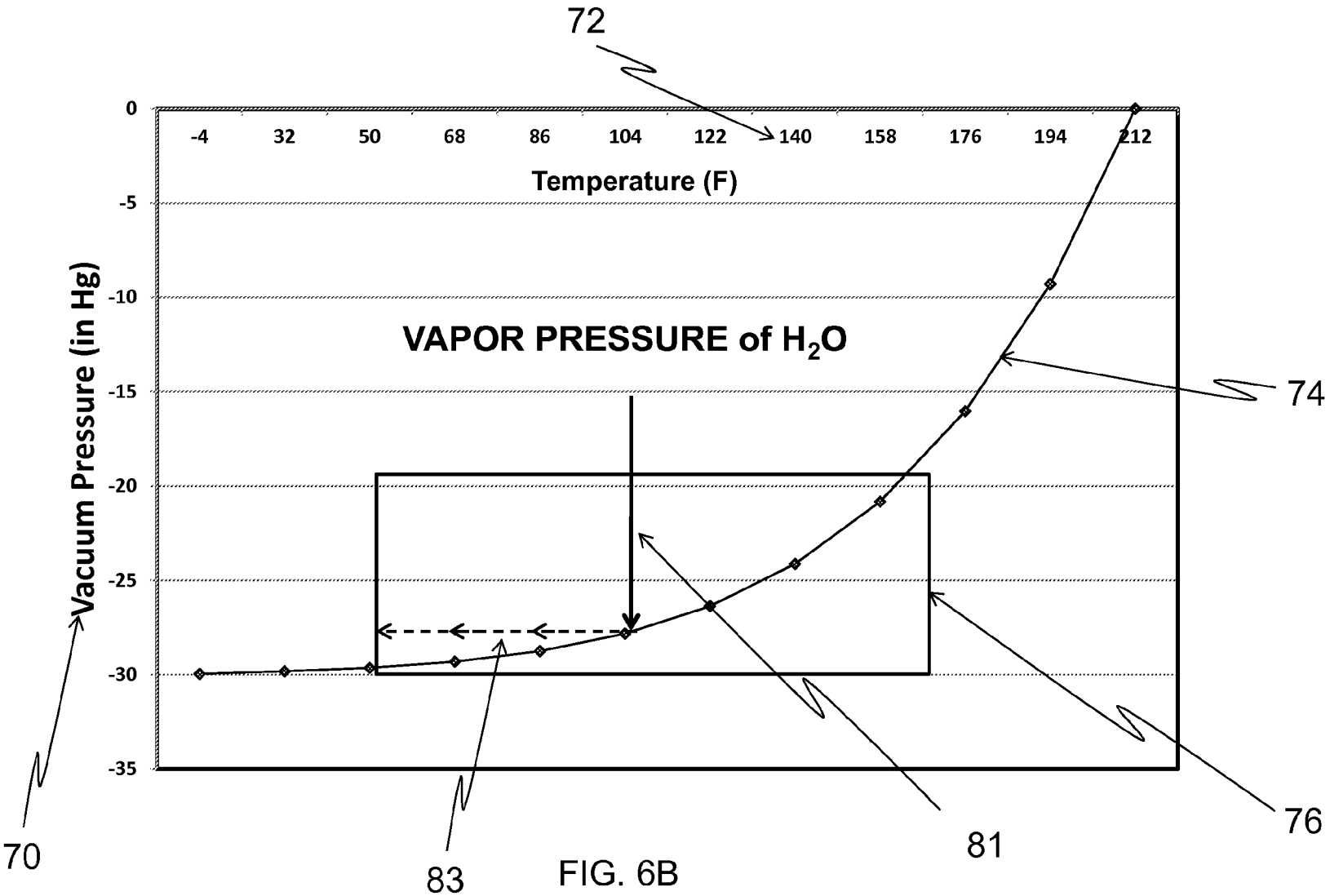
FIG. 6B is a graphical representation of the vapor pressure curve of water at a particular vacuum pressure depicting the loss of heat as a result of the latent heat of evaporation.
Figure 6C:
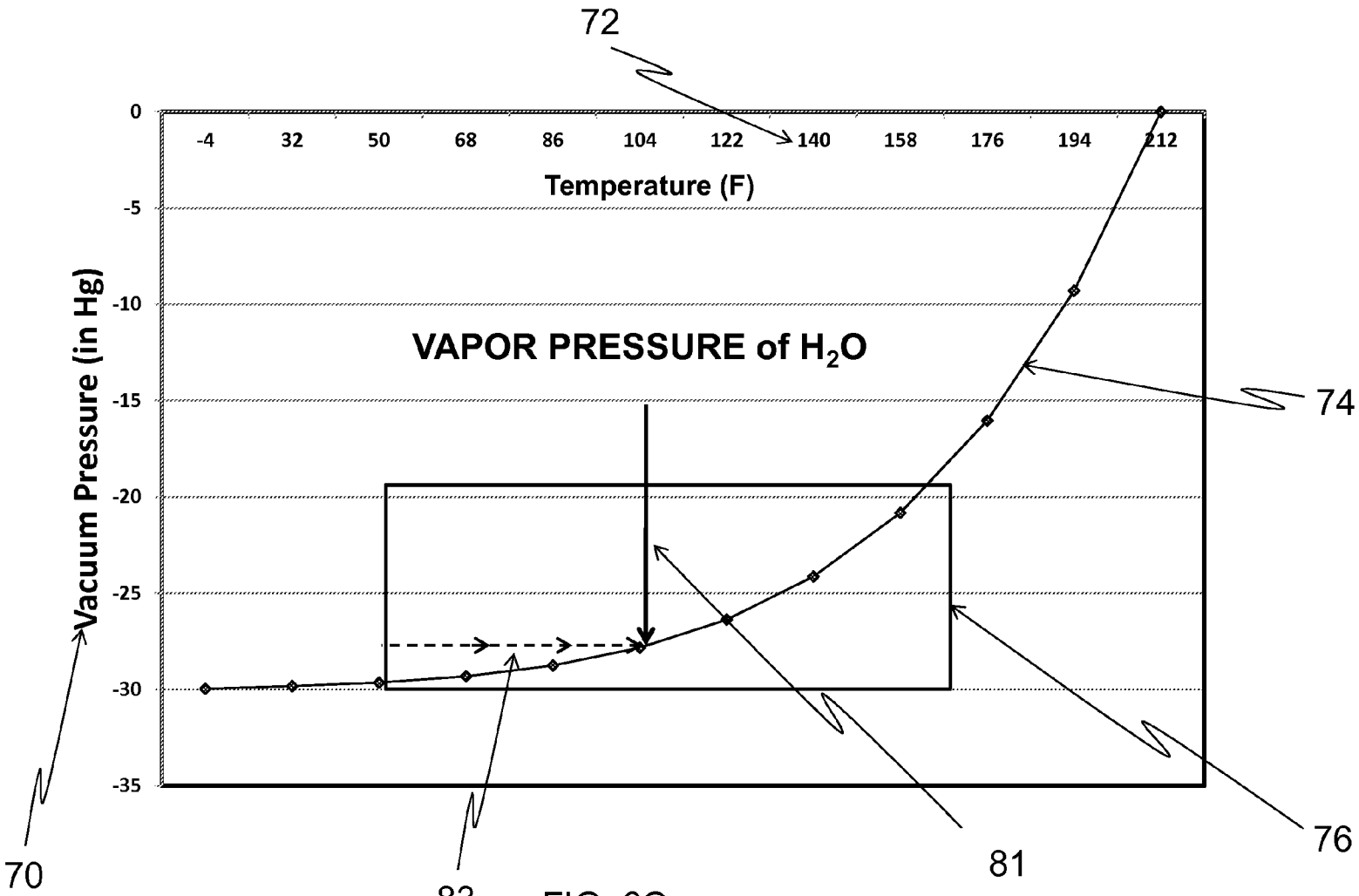
FIG. 6C is a graphical representation of the vapor pressure curve of water at a particular vacuum pressure depicting the gain of heat as a result of the conduction platen heating.

Referring to FIGS. 6A-6C, a graphical representation of water vapor pressure curve 74 is derived from known vapor pressure conversions that relate temperature of the water 72 and vacuum pressure of the air surrounding the water 70. Using the example depicted in FIG. 6B, water maintained at temperature 81 (approximately 104 deg. F) will begin to boil at vacuum pressure 83 (approximately −27 in Hg). Using vapor pressure curve 74, a target or preferred heating and evacuation drying zone 76 for the automatic drying of portable electronic devices was determined. The upper temperature limit of the evacuation drying zone 76 may be governed by the temperature at which materials used to construct the electronic device being dried will begin to deform or melt. The lower temperature limit of the evacuation drying zone 76 may be governed by the ability of evacuation pump 41 to generate the low pressure or the amount of time required for evacuation pump 41 to achieve the low pressure. FIGS. 6A-6C depict the preferred limits of the vacuum generated by evacuation pump 41 to be approximately −28 to approximately −30 inches of Hg.

Figure 7:
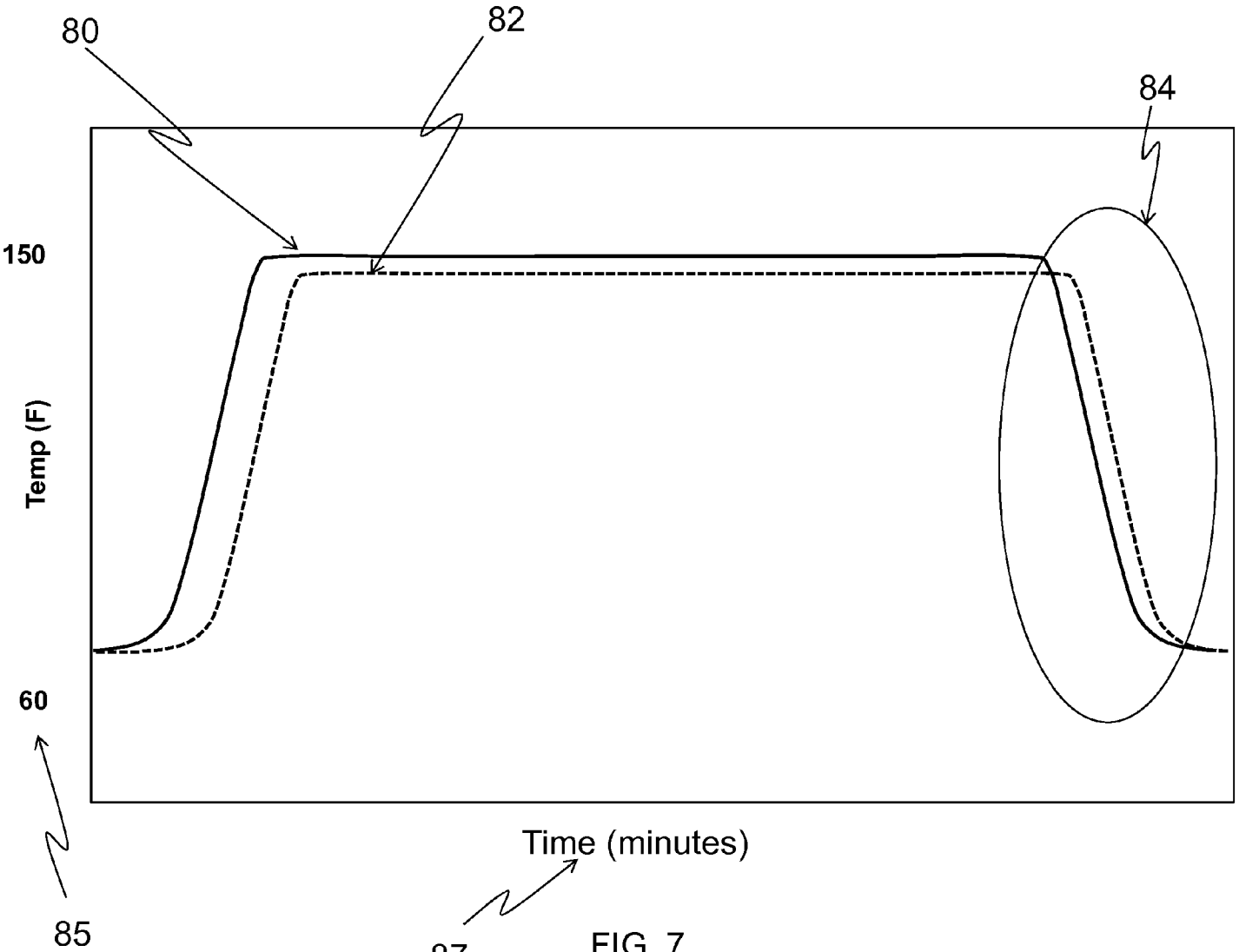
FIG. 7 is a graphical representation of the heated platen temperature and associated electronic device temperature without vacuum applied according to one embodiment of the present disclosure.

Referring to FIG. 7, a graphical representation of heated conduction platen heating curve 80 that is being heated to a temperature value on temperature axis 85 over some time depicted on time axis 87 according to one embodiment of the present invention. A portable electronic device resting on heated conduction platen 16 is subjected to heated conduction platen heating curve 80 and generally heats according to device heating curve 82. Device heating curve 82 is depicted lagging in time due to variation in thermal conduction coefficients.

Now referring to FIG. 8, a graphical representation of heated conduction platen heating curve 80 is depicted with temperature axis 85 over some time on time axis 87 together with vacuum pressure axis 92 according to another embodiment of the present invention. As a result of changing vacuum pressure curve 98 and by virtue of the latent heat escaping due to vapor evaporation of wetted portable electronic device, device heating curve 96 is produced.

When the moisture within the device evaporates, the device would typically cool due to the latent heat of evaporation. The addition of heat to the process minimizes the cooling of the device and helps to enhance the rate at which the moisture can be removed from the device.

Figure 9:
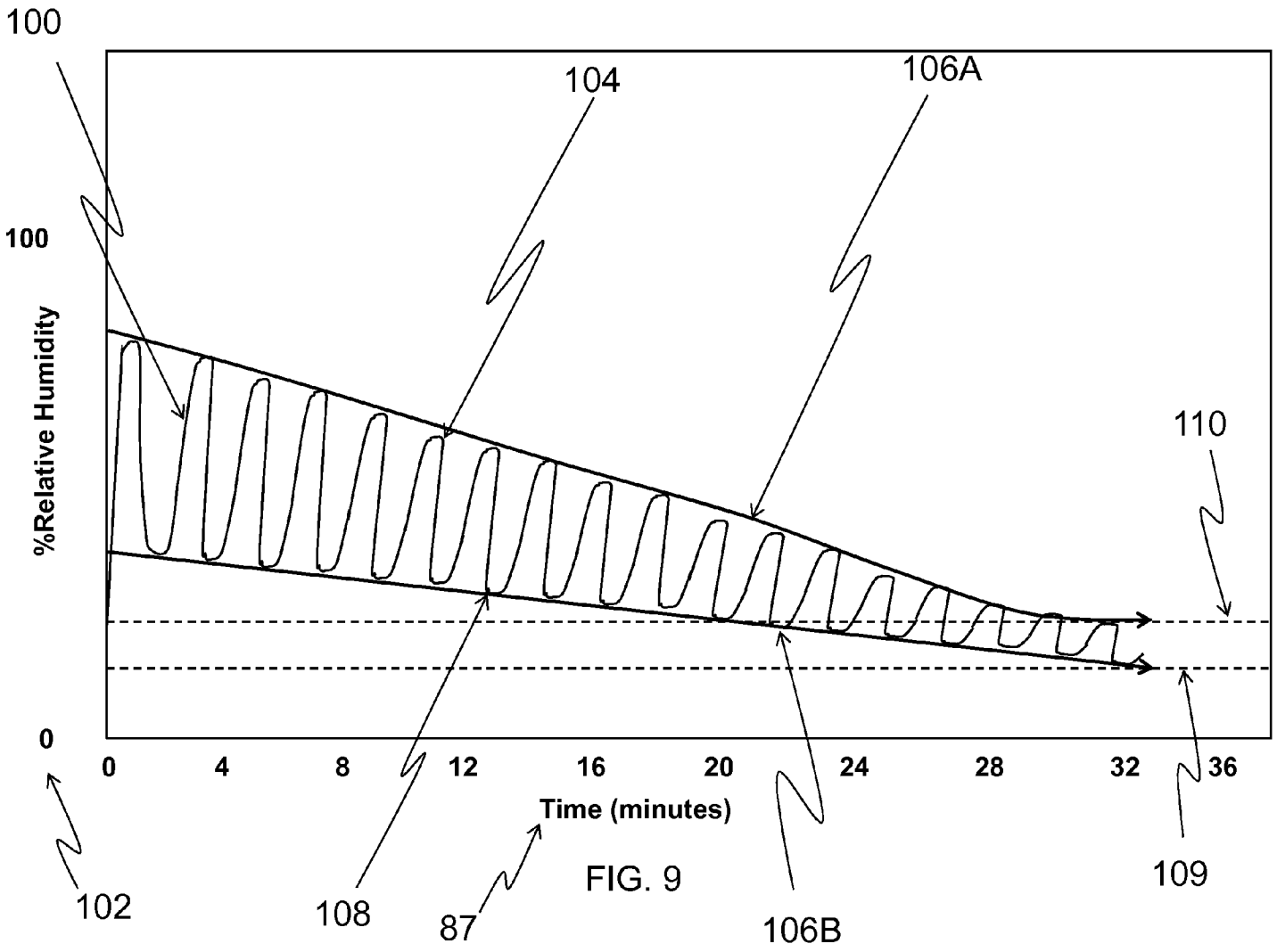
FIG. 9 is a graph depicting the relative humidity sensor output that occurs during the successive heating and vacuum cycles of the electronic device drying apparatus according to one embodiment of the present invention.

Referring to FIG. 9, a graphical representation of relative humidity sensor 61 is depicted with relative humidity axis 102 plotted against cycle time axis 87 according to an embodiment of the present invention. As moisture vaporizes in portable electronic device, the vaporization produces a relative humidity curve 100 that becomes progressively smaller and follows reduction line 106. Relative humidity peaks 104 get successively lowered and eventually minimize to room humidity 108.

In one embodiment, the electronic device drying apparatus 1 operates as follows:

A portable electronic device that has become wet or been exposed to humidity is inserted into convection chamber 4 by opening door 22 and placing the device under vacuum chamber 3 that has been lifted off heated conduction platen 16. The lifting of vacuum chamber 3 can be done manually or with a lifting mechanism. Door 22 can be hinged on top of convection chamber 4. (Either method does not take away from or enhance the spirit or intent of the invention.)

To initiate a drying cycle operation, the user then pushes or activates on-off switch 19 in order to power on drying apparatus 1. Once the apparatus 1 is powered up, the user selects, via input device selection switches (see FIGS. 1 and 5) the appropriate electronic device for drying. Control microprocessor 44 senses the user's switch selection via user interface buss 48 by polling the input device selection switches 11, and subsequently acknowledges the user's selection by lighting the appropriate input device selection indicator light 15 (FIG. 1) for the appropriate selection. Microprocessor 44 houses software in non-volatile memory 45 and communicates with the software code over memory interface buss 49.

In one embodiment of the invention, memory 45 contains algorithms for the various portable electronic devices that can be dried by this invention—each algorithm containing specific heated conduction platen 16 temperature settings—and the correct algorithm is automatically selected for the type of electronic device inserted into apparatus 1.

In one embodiment, microprocessor 44 activates or powers on heated conduction platen 16 via control transistor 54 that switches power supply 53 positive and negative supply lines 58 and 55, respectively, into heater power wires 10. This switching of power causes thermofoil resistance heater 21 to generate heat via resistance heating. Thermofoil resistance heater 21, which is in thermal contact with (and can be laminated to) heated conduction platen 16, begins to heat to the target temperature and through, for example, physical contact with the subject device, allows heat to flow into and within the device via thermal conduction. In certain embodiments, the target temperature for the heated platen is at least 70 deg. F. and at most 150 deg. F. In further embodiments, the target temperature for the heated platen is at least approximately 110 deg. F. and at most approximately 120 deg. F.

In alternate embodiments the heating of heated conduction platen 16 is accomplished in alternate ways, such as by hot water heating, infrared lamps, incandescent lamps, gas flame or combustible fuel, Fresnel lenses, steam, human body heat, hair dryers, fissile materials, or heat produced from friction. Any of these heating methods would produce the necessary heat for heated conduction platen 16 to transfer heat to a portable electronic device.

During operation, microprocessor 44 polls heated platen temperature sensor 8 (via heated platen temperature sensor signal line 26) and provides power to the platen 16 until platen 16 achieves the target temperature. Once the target temperature is achieved, microprocessor 44 initiates a timer, based on variables in memory 45 via memory interface buss 49, that allows enough time for heated conduction plate 16 to transfer heat into the portable electronic device. In some embodiments, platen 16 has a heated conduction platen heating profile 80 that takes a finite time to achieve a target temperature. Heating profile 80 (FIG. 7) is only one such algorithm, and the target temperature can lie on any point on temperature axis 85. As a result of heated conduction platen 16 transferring heat into the subject device, device temperature profile 82 is generated. In general, portable electronic device temperature profile 82 follows the heated conduction platen heating profile 80, and can generally fall anywhere on the temperature axis 85. Without further actions, the heated conduction platen heating profile 80 and portable electronic device heating profile 82 would reach a quiescent point and maintain these temperatures for a finite time along time 87. If power was discontinued to apparatus 1, the heated conduction platen heating profile 80 and portable electronic device heating profile 85 would cool per profile 84.

During the heating cycle, vacuum chamber 3 can be in open position 17 or closed position 18 as shown in FIGS. 4A and 4B. Either position has little affect on the conductive heat transfer from heated conduction platen 16 to the portable electronic device.

Convection chamber fan 9 may be powered (via fan control signal line 24 electrically connected to microprocessor 44) to circulate the air within convection chamber 4 and outside vacuum chamber 3. The air within convection chamber 4 is heated, at least in part, by radiated heat coming from heated conduction platen 16. Convection chamber fan 9 provides circulation means for the air within the convection chamber 4 and helps maintain a relatively uniform heated air temperature within convection chamber 4 and surrounding vacuum chamber 3. Microprocessor 44 can close atmospheric vent solenoid valve 67 by sending an electrical signal via atmospheric vent solenoid valve control signal line 69.

In one embodiment of the invention, there are separate heating elements to control the heat within the convection chamber 4. These heating elements can be common electrical resistance heaters. In one embodiment, platen 16 can be used to heat convection chamber 4 without the need for a separate convection chamber heater.

In operation, microprocessor 44 signals the user, such as via audible indicator 20 (FIGS. 1 and 5) that heated conduction platen 4 has achieved target temperature and can initiate an audible signal on audible indicator 20 for the user to move vacuum chamber 3 from the open position 17 to the closed position 18 (see FIGS. 4A and 4B) in order to initiate the drying cycle. Start-stop switch 13 may then be pressed or activated by the user, whereupon microprocessor 44 senses this action through polling user interface buss 48 and sends a signal to convection vent solenoid valve 57 (via convection chamber vent solenoid control signal wire 56), which then closes atmospheric vent 6 through pneumatically connected atmospheric vent manifold 64. The closure of the convection chamber vent solenoid valve 57 ensures that the vacuum chamber 3 is sealed when the evacuation of its interior air commences.

After the electronic device is heated to a target temperature (or in alternate embodiments when the heated platen reaches a target temperature) and after an optional time delay, the pressure within the vacuum chamber is decreased. In at least one embodiment, microprocessor 44 sends a control signal to motor relay 42 (via motor relay control signal line 66) to activate evacuation pump 41. Motor relay 42 powers evacuation pump 41 via evacuation pump power line 68. Upon activation, evacuation pump 41 begins to evacuate air from within vacuum chamber 3 through evacuation port 7, which is pneumatically connected to evacuation manifold 62. Microprocessor 44 can display elapsed time as on display timer 14 (FIG. 1). As the evacuation of air proceeds within vacuum chamber 3, vacuum chamber sealing surface 31 compresses vacuum chamber sealing O-ring 5 against heated conduction platen 16 surface to provide a vacuum-tight seal. Evacuation manifold 62 is pneumatically connected to a vacuum pressure sensor 43, which directs vacuum pressure analog signals to the microprocessor 44 via vacuum pressure signal line 52 for purposes of monitoring and control in accordance with the appropriate algorithm for the particular electronic device being processed.

As air is being evacuated, microprocessor 44 polls heated conduction platen 16 temperature, vacuum chamber evacuation pressure sensor 43, and relative humidity sensor 61, via temperature signal line 26, vacuum pressure signal line 52, and relative humidity signal line 65, respectively. During this evacuation process, the vapor pressure point of, for example, water present on the surface of components within the portable electronic device follows known vapor pressure curve 74 as shown in FIGS. 6A-6C. In some embodiments, microprocessor 44 algorithms have target temperature and vacuum pressure variables that fall within, for example, a preferred vacuum drying target zone 76. Vacuum drying target zone 76 provides water evaporation at lower temperatures based on the reduced pressure within the chamber 4. Microprocessor 44 can monitor pressure (via vacuum pressure sensor 43) and relative humidity (via relative humidity sensor 61), and control the drying process accordingly.

As the pressure within the chamber decreases, the temperature of the electronic device will typically drop, at least in part due to the escape of latent heat of evaporation and the vapor being scavenged through evacuation manifold 62, despite the heated platen (or whatever type of component is being used to apply heat) being maintained at a constant temperature. The drop in pressure will also cause the relative humidity to increase, which will be detected by relative humidity sensor 61 being pneumatically connected to evacuation manifold 62.

After the pressure within the chamber has been decreased, it is again increased. This may occur after a predetermined amount of time or after a particular state (such as the relative humidity achieving or approaching a steady state value) is detected. The increase in pressure may be accomplished by microprocessor 44 sending a signal to convection chamber vent solenoid valve 57 and atmospheric vent solenoid valve 67 (via convection chamber vent solenoid valve control signal 56 and atmospheric solenoid valve control signal 69) to open. This causes air, which may be ambient air, to enter into atmospheric control solenoid valve 67, and thereby vent convection chamber 4. The opening of convection vent solenoid valve 57, which may occur simultaneously with the opening of convection chamber vent solenoid valve 57 and/or atmospheric vent solenoid valve 67, allows heated air within convection chamber 4 to be pulled into the vacuum chamber 3 by vacuum pump 41. Atmospheric air (e.g., room air) gets drawn in due to the evacuation pump 41 remaining on and pulling atmospheric air into vacuum chamber 3 via atmospheric vent manifold 64 and evacuation manifold 62.

After the relative humidity has been reduced (as optionally sensed through relative humidity sensor 61 and a relative humidity sensor feedback signal sent via relative humidity sensor feedback line 65 to microprocessor 44), convection chamber vent solenoid valve 57 and atmospheric solenoid valve 67 may be closed, such as via convection chamber vent solenoid valve control signal 56 and atmospheric solenoid valve control signal 69, and the pressure within the vacuum chamber is again decreased.

This sequence can produce an evacuation chamber profile curve 98 (FIGS. 8B and 8C) that may be repeated based on the selected algorithm and controlled under microprocessor 44 software control. Repetitive vacuum cycling (which may be conducted under constant heating) causes the wetting agent to be evaporated and forced to turn from a liquid state to a gaseous state. This gaseous state of the water allows the resultant water vapor to escape through the torturous paths of the electronic device, through which liquid water may not otherwise escape.

In at least one embodiment, microprocessor 44 detects relative humidity peaks 104 (depicted in FIG. 9), such as by using a software algorithm that determines the peaks by detecting a decrease or absence of the rate at which the relative humidity is changing. When a relative humidity peak 104 is detected, the pressure within the vacuum chamber will be increased (such as by venting the vacuum chamber), and the relative humidity will decrease. Once the relative humidity reaches a minimum relative humidity 108 (which may be detected by a similar software algorithm to the algorithm described above), another cycle may be initiated by decreasing the pressure within the vacuum chamber.

Figure 8A:
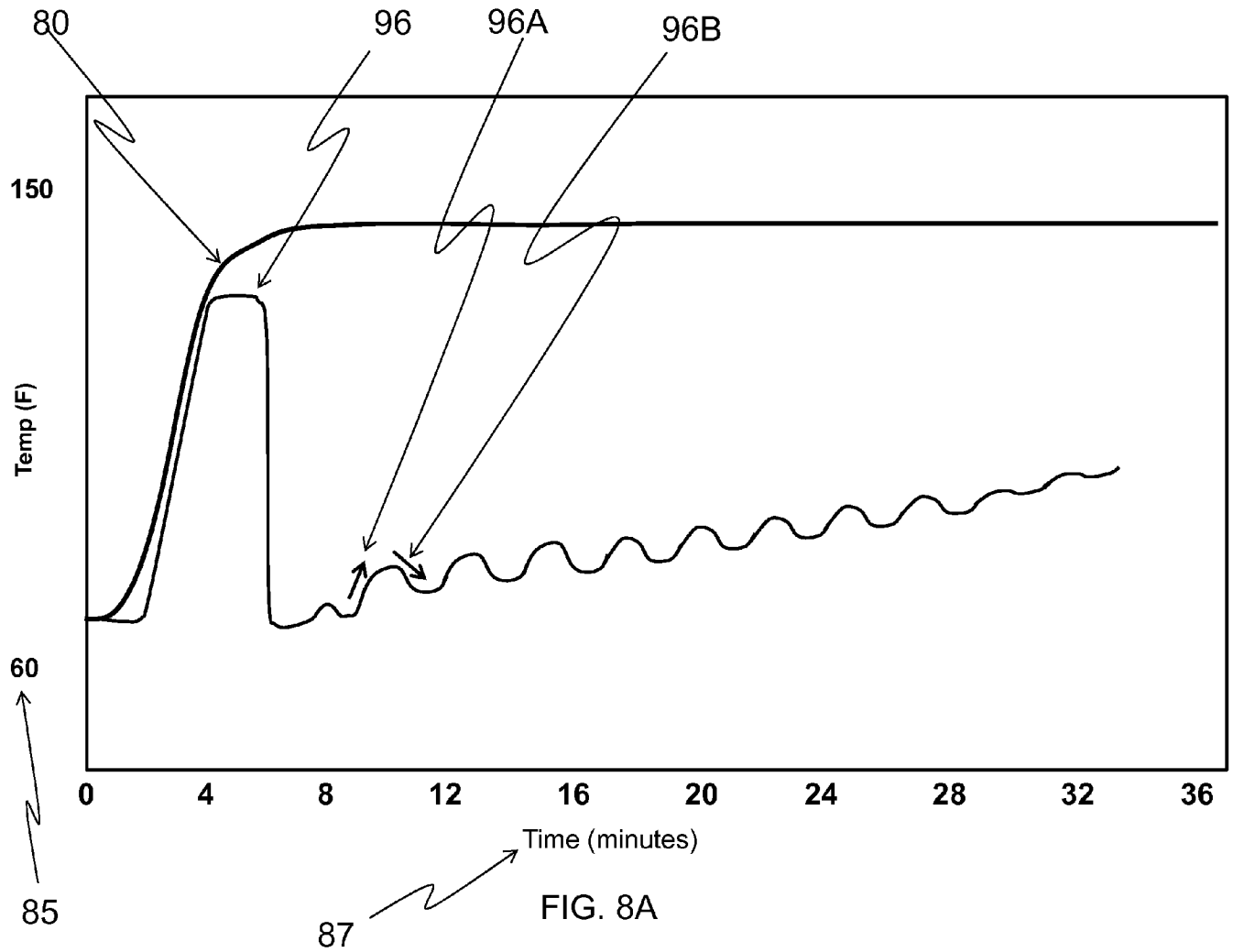
FIG. 8A is a graph depicting the heated platen temperature and associated electronic device temperature response with vacuum cyclically applied and then vented to atmospheric pressure for a period of time according to another embodiment of the present disclosure.
Figure 8B:
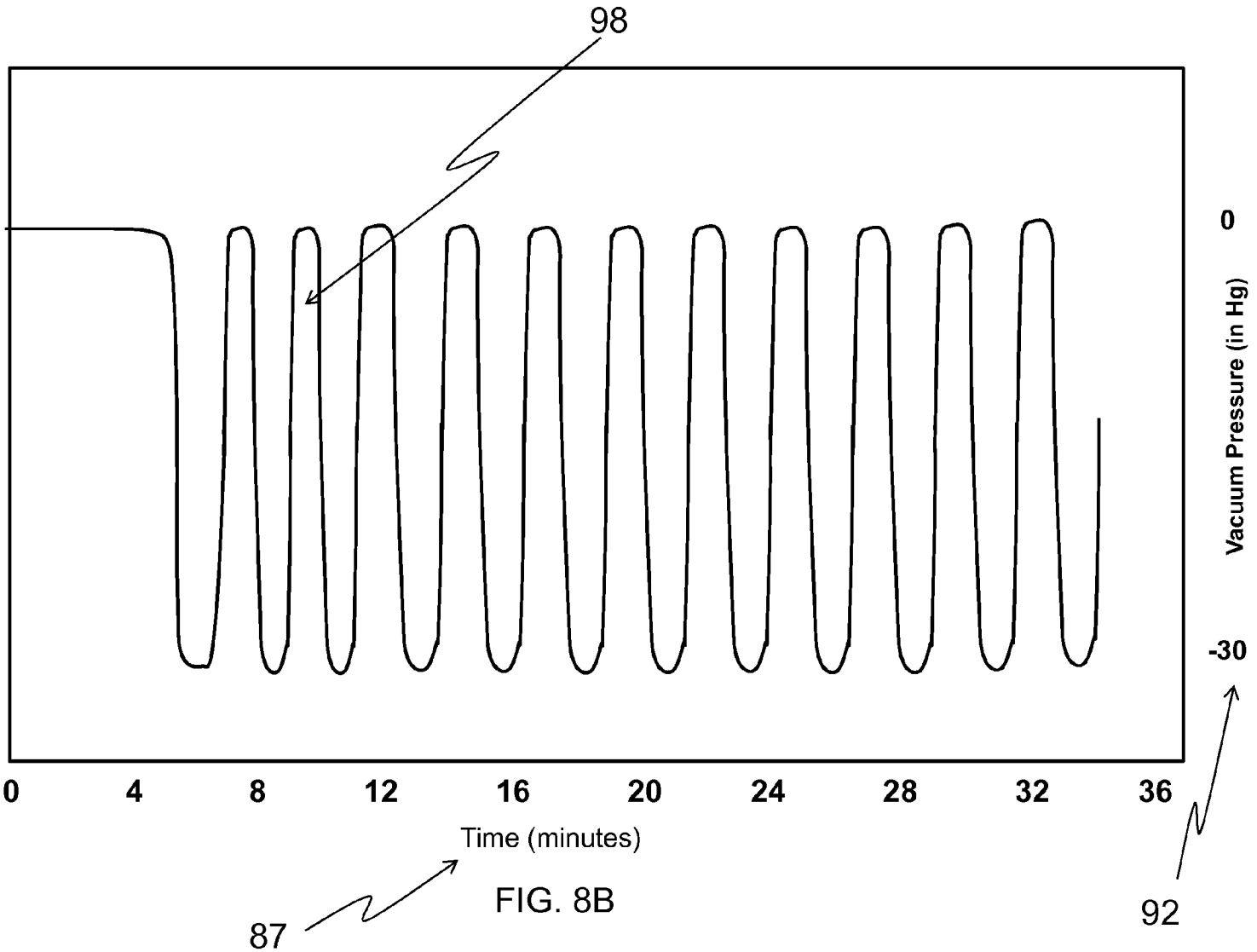
FIG. 8B is a graph depicting the vacuum cyclically applied and then vented to atmospheric pressure for a period of time according to another embodiment of the present disclosure.
Figure 8C:
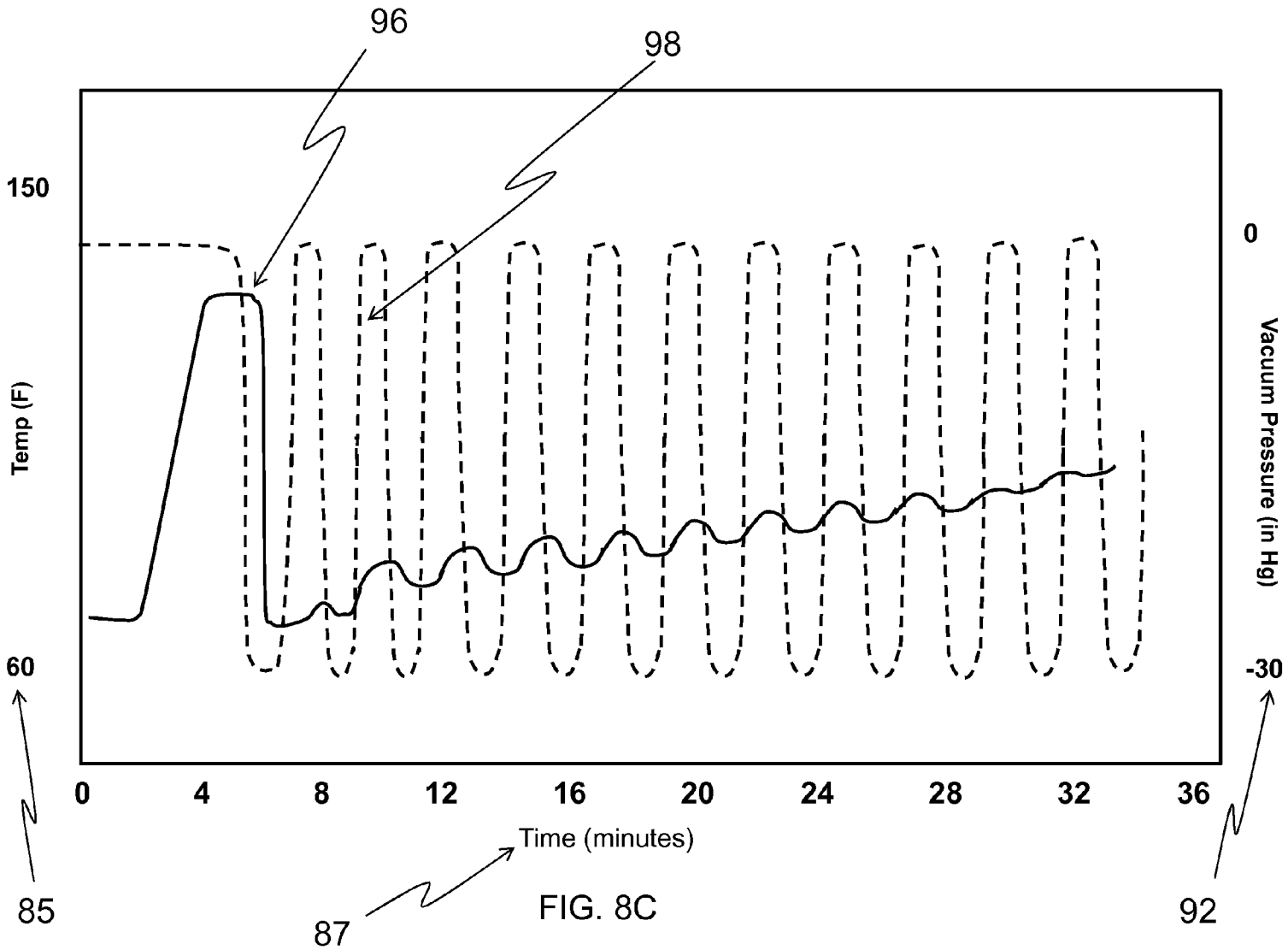
FIG. 8C is a graph depicting the vacuum cyclically applied and then vented to atmospheric pressure with the electronic device temperature response superimposed for a period of time according to another embodiment of the present disclosure.

Referring now to FIGS. 8A and 8C, response curve directional plotting arrow 96A generally results from the heat gain when the system is in a purge air recovery mode, which permits the electronic device to gain heat. Response curve directional plotting arrow 96B generally results from latent heat of evaporation when the system is in vacuum drying mode. As consecutive cycles are conducted, the temperature 96 of the electronic device will tend to gradually increase, and the changes in temperature between successive cycles will tend to decrease.

In some embodiments, microprocessor 44 continues this repetitive or cyclical heating and evacuation of vacuum chamber 3, producing a relative humidity response curve 100 (FIG. 9). This relative humidity response curve 100 may be monitored by the software algorithm with relative humidity cyclic maximums 104 and cyclic minimums 108 stored in registers within microprocessor 44. In alternate embodiments, relative humidity maximums 104 and minimums 108 will typically follow a relative humidity drying profile 106A and 106B and are asymptotically minimized over time to minimums 109 and 110. Through one or more successive heating cycles 96 and evacuation cycles 98, as illustrated in FIG. 8, the portable electronic device arranged within the vacuum chamber 3 is dried. Control algorithms within microprocessor 44 can determine when the relative humidity maximum 104 and relative humidity minimum 108 difference is within a specified tolerance to warrant deactivating or stopping vacuum pump 41.

The system can automatically stop performing consecutive drying cycles when one or more criteria are reached. For example, the system can stop performing consecutive drying cycles when a parameter that changes as the device is dried approaches or reaches a steady-state or end value. In one example embodiment, the system automatically stops performing consecutive drying cycles when the relative humidity falls below a certain level or approaches (or reaches) a steady-state value. In another example embodiment, the system automatically stops performing consecutive drying cycles when the difference between maximum and minimum relative humidity in a cycle falls below a certain level. In still another example embodiment, the system automatically stops performing consecutive drying cycles when the temperature 96 of the electronic device approaches or reaches a steady-state value.

Referring again to FIGS. 1 and 5, microprocessor 44 may be remotely connected to the Internet via, e.g., an RJ11 modem Internet connector 12 that is integrated to the modem interface 46. Microprocessor 44 may thus send an Internet or telephone signal via modem Internet interface 46 and RJ11 Internet connector 12 to signal the user that the processing cycle has been completed and the electronic device sufficiently dried.

Thus, simultaneous conductive heating and vacuum drying can be achieved and tailored to specific electronic devices based upon portable electronic materials of construction in order to dry, without damage, the various types of electronic devices on the market today.

In alternate embodiments, an optional desiccator 63 (FIG. 5) may be connected to evacuation manifold 62 upstream of evacuation pump 41. One example location for desiccator 63 is downstream of relative humidity sensor 61 and upstream of evacuation pump 41. When included, desiccator 63 can absorb the moisture in the air coming from vacuum chamber 3 prior to the moisture reaching evacuation pump 41. In some embodiments, desiccator 63 can be a replaceable cartridge or regenerative type desiccator.

In embodiments were the evacuation pump is of the type that uses oil, there can be a tendency for the oil in an evacuation pump to scavenge (or absorb) water from the air, which can lead to entrainment of water into the evacuation pump, premature breakdown of the oil in the evacuation pump, and/or premature failure of the evacuation pump itself. In embodiments where the evacuation pump is of the oil-free type, high humidity conditions can also lead to premature failure of the pump. As such, advantages may be realized by removing water (or possibly other air constituents) from the air with desiccator 63 before the air reaches evacuation pump 41.

Although many of the above embodiments describe drying apparatuses and methods that are automatically controlled, other embodiments include drying apparatuses and methods that are manually controlled. For example, in one embodiment a user controls application of heat to the wetted device, application of a vacuum to the wetted device, and release of the vacuum to the wetted device.

Figure 10:
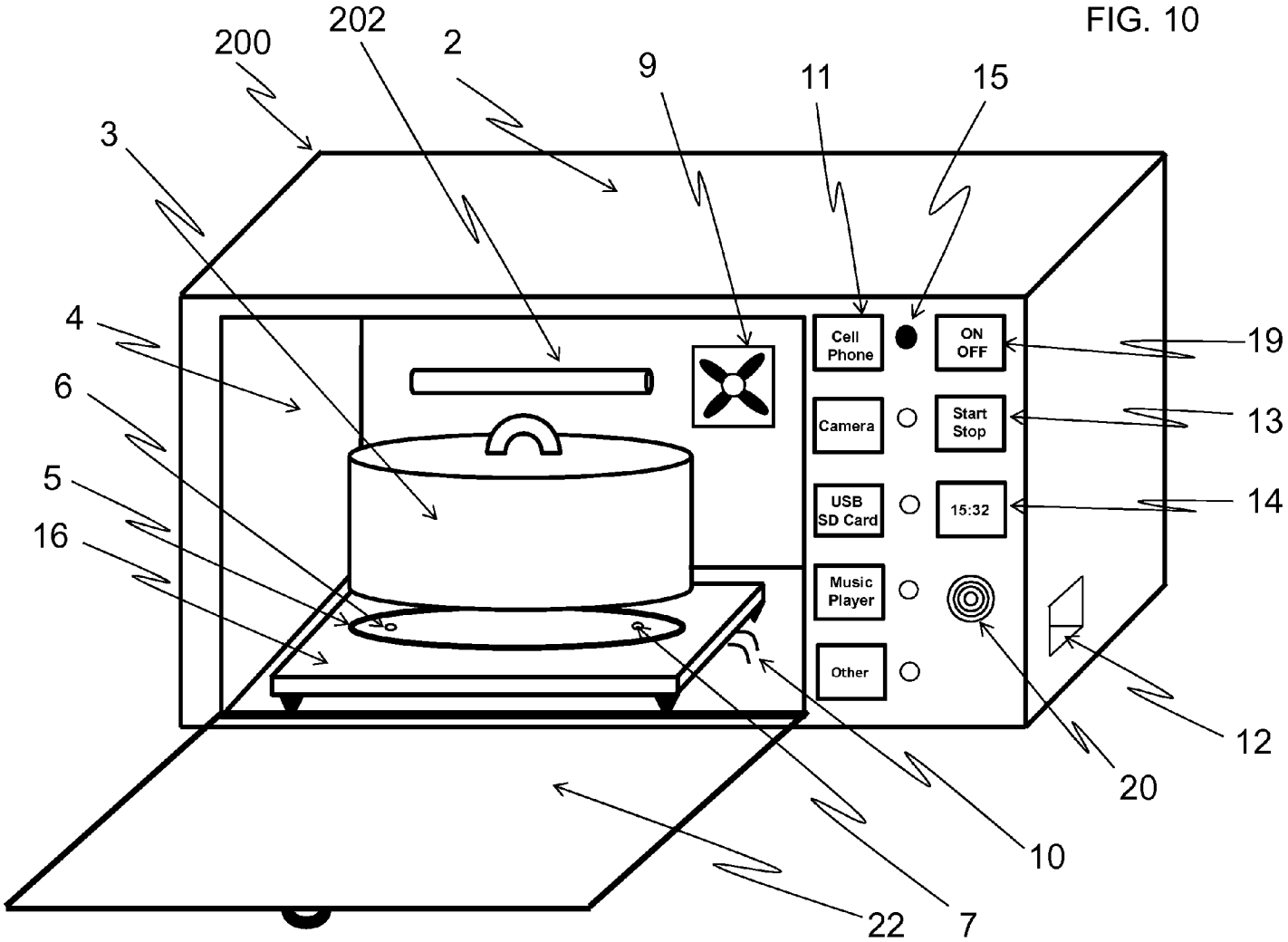
FIG. 10 is an isometric view of an electronic device drying apparatus and germicidal member according to another embodiment of the present disclosure.

Depicted in FIG. 10 is a drying apparatus, e.g., an automatic portable electronic device drying apparatus 200, according to another embodiment of the present invention. Many features and components of drying apparatus 200 are similar to features and components of drying apparatus 1, with the same reference numerals being used to indicate features and components that are similar between the two embodiments. Drying apparatus 200 includes a disinfecting member, such as ultraviolet (UV) germicidal light 202, that may, for example, kill germs. Light 202 may be mounted inside convection chamber 4 and controlled by a UV germicidal light control signal 204. In one embodiment, the UV germicidal light 202 is mounted inside convection chamber 4 and outside vacuum chamber 3, with the UV radiation being emitted by germicidal light 202 and passing through vacuum chamber 3, which may be fabricated from UV light transmissive material (one example being Acrylic plastic). In an alternate embodiment, UV germicidal light 202 is mounted inside vacuum chamber 3, which may have benefits in embodiments where vacuum chamber 3 is fabricated from non-UV light transmissive material.

In one embodiment, the operation of drying apparatus 200 is similar to the operation of drying apparatus 1 as described above with the following changes and clarifications. Microprocessor 44 sends control signal through UV germicidal lamp control line 204 and powers-up UV germicidal lamp 202, which may occur at or near the activation of heated conduction platen 16 by microprocessor 44. In one embodiment, UV germicidal lamp 202 will then emit UV waves approximately in the 254 nm wavelength, which can penetrate vacuum chamber 3, particularly in embodiments where vacuum chamber 3 is fabricated from clear plastic in one embodiment.

Figure 11:
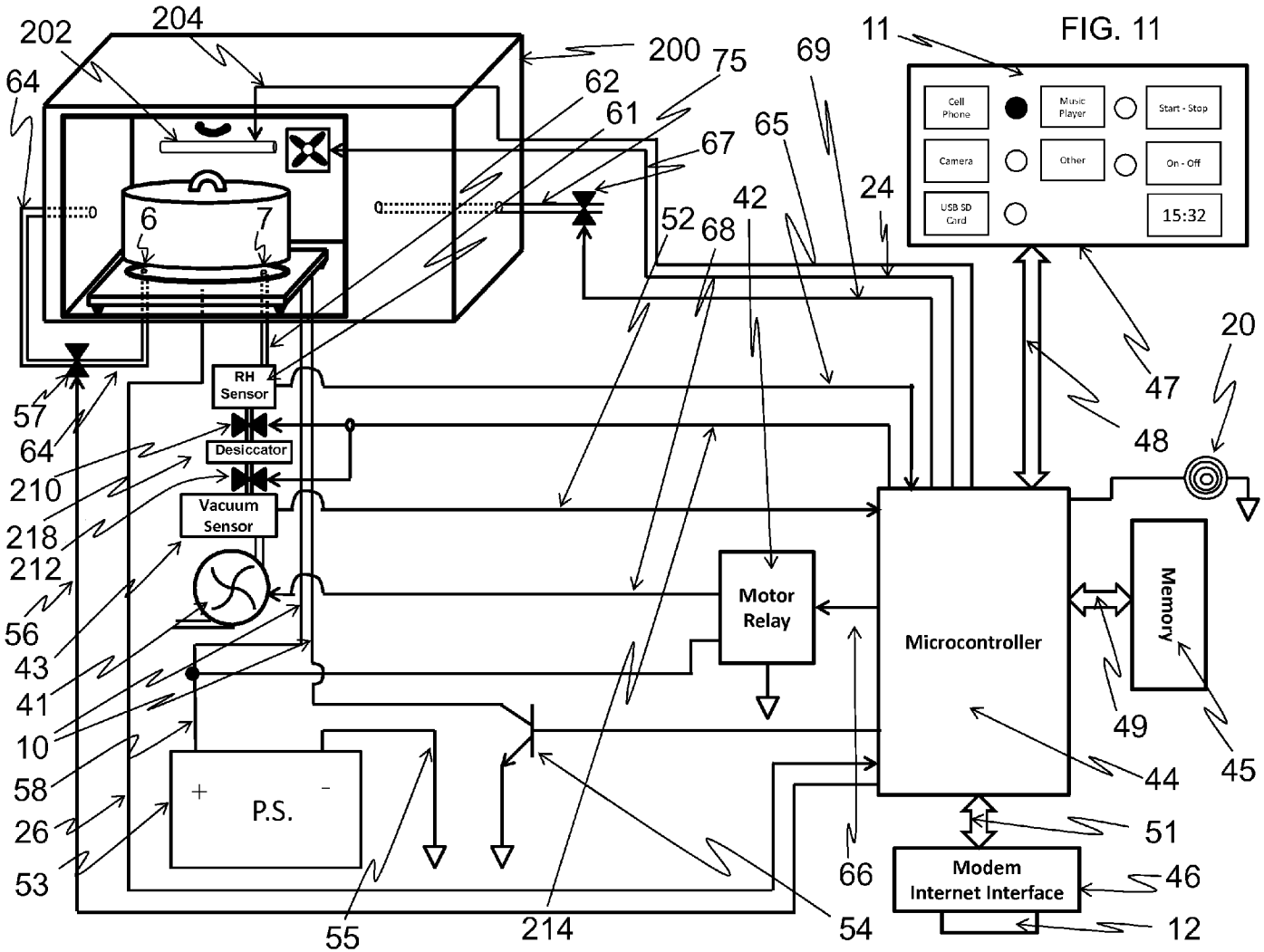
FIG. 11 is a block diagram depicting an electronics control system, electronic device drying apparatus, and germicidal member according to a further embodiment of the present disclosure.

In still further embodiments, one or more desiccators 218 may be isolated from evacuation manifold 62, which may have advantages when performing periodic maintenance or performing automated maintenance cycles of the drying apparatus. As one example, the embodiment depicted in FIGS. 11-13 includes valves (e.g., 3-way air purge solenoid valves 210 and 212) that can selectively connect and disconnect desiccator 218 from evacuation manifold 62. Solenoid valve 210 is positioned between relative humidity sensor 61 and desiccator 218, and solenoid valve 212 positioned between desiccator 218 and vacuum sensor 43. In the illustrated embodiment, 3-way air purge valves 210 and 212 have their common distribution ports pneumatically connected to desiccator 218. This common port connection provides simultaneous isolation of desiccator 218 from exhaust manifold 62 and disconnection of exhaust manifold 62 and vacuum pump 41. This disconnection prevents moisture from vacuum chamber 3 reaching vacuum pump 41 while desiccator 63 is being regenerated. Operation of this embodiment is similar to the embodiment described in relation to FIG. 5 with the following changes and clarifications.

An optional desiccator heater 220 and optional desiccator air purge pump 224 may be included. While desiccator 218 is isolated from evacuation manifold 62 and vacuum pump 41, desiccator 218 may be heated by desiccator heater 220 without affecting vacuum manifold 62 and associated pneumatic vacuum circuitry. As desiccant inside desiccator 218 is heated, for example to a target temperature, to bake off absorbed moisture, purge pump 224 can modulate (for example, according to a maintenance control algorithm with a prescribed time and/or temperature profile commanded by microprocessor 44) to assist in the removal of moisture from desiccant 218. In certain embodiments, the target temperature for the desiccator heater is at least 200 deg. F. and at most 300 deg. F. In further embodiments, the target temperature for the desiccator heater is approximately 250 deg. F.

As purge pump 224 is modulated, atmospheric air is forced along air path 235, across the desiccant housed inside desiccator 218, and the moisture laden air is blown off through atmospheric port 238. An optional desiccator cooling fan 222 may be included (and optionally modulated by microprocessor 44) to reduce the desiccant temperature inside desiccator 218 to a temperature suited for the desiccant to absorb moisture rather than outgas moisture.

When the drying cycle is initiated according to one embodiment, atmospheric vent 6 is closed and microprocessor 44 sends control signals via 3-way air purge solenoid control line 214 to 3-way air purge solenoid valves 210 and 212. This operation closes 3-way air purge solenoid valves 210 and 212 and allows vacuum pump 41 to pneumatically connect to evacuation manifold 62. This pneumatic connection allows evacuated air to flow along air directional path 215, through evacuation manifold 62 and through desiccator 218 before reaching vacuum pump 41. One advantage that may be realized by removing moisture from the evacuated air prior to reaching vacuum pump 41 is a dramatic decrease in the failure rate of vacuum pump 41.

After microprocessor 44 algorithm senses that the portable electronic device is dried, microprocessor 44 may signal the system to enter a maintenance mode. UV germicidal light 202 may be powered off via UV germicidal light control line 204 from microprocessor 44. Microprocessor 44 powers desiccator heater 220 via desiccator heater power relay control signal 166 and desiccators heater power relay 228. Control signal 226 is the control signal for relay 228. The temperature of desiccator 218 may be sampled by microprocessor 44 via desiccator temperature probe 230, and the heating of desiccator 218 may be controlled to a specified temperature that begins baking out the moisture in desiccant housed in desiccator 218. The 3-way air purge solenoid valves 210 and 212 may be electrically switched via 3-way air purge solenoid control line 202 when it is determined that sufficient drying has occurred, which may occur at a finite time specified by microprocessor 44 maintenance algorithm. Air purge pump 224 may then be powered on by microprocessor 44 via air purge pump control signal 232 to flush moisture-laden air through desiccator 218 and into atmospheric vent port 238. Microprocessor 44 may use a timer in the maintenance algorithm to heat and purge moisture-laden air for a finite time. Once the optional maintenance cycle is complete, microprocessor 44 may turn on desiccator cooling fan 222 to cool desiccator 218. Microprocessor 44 may then turn off air purge pump 224 to ready the system for the drying and optional disinfecting of another electronic device.

Figure 12:
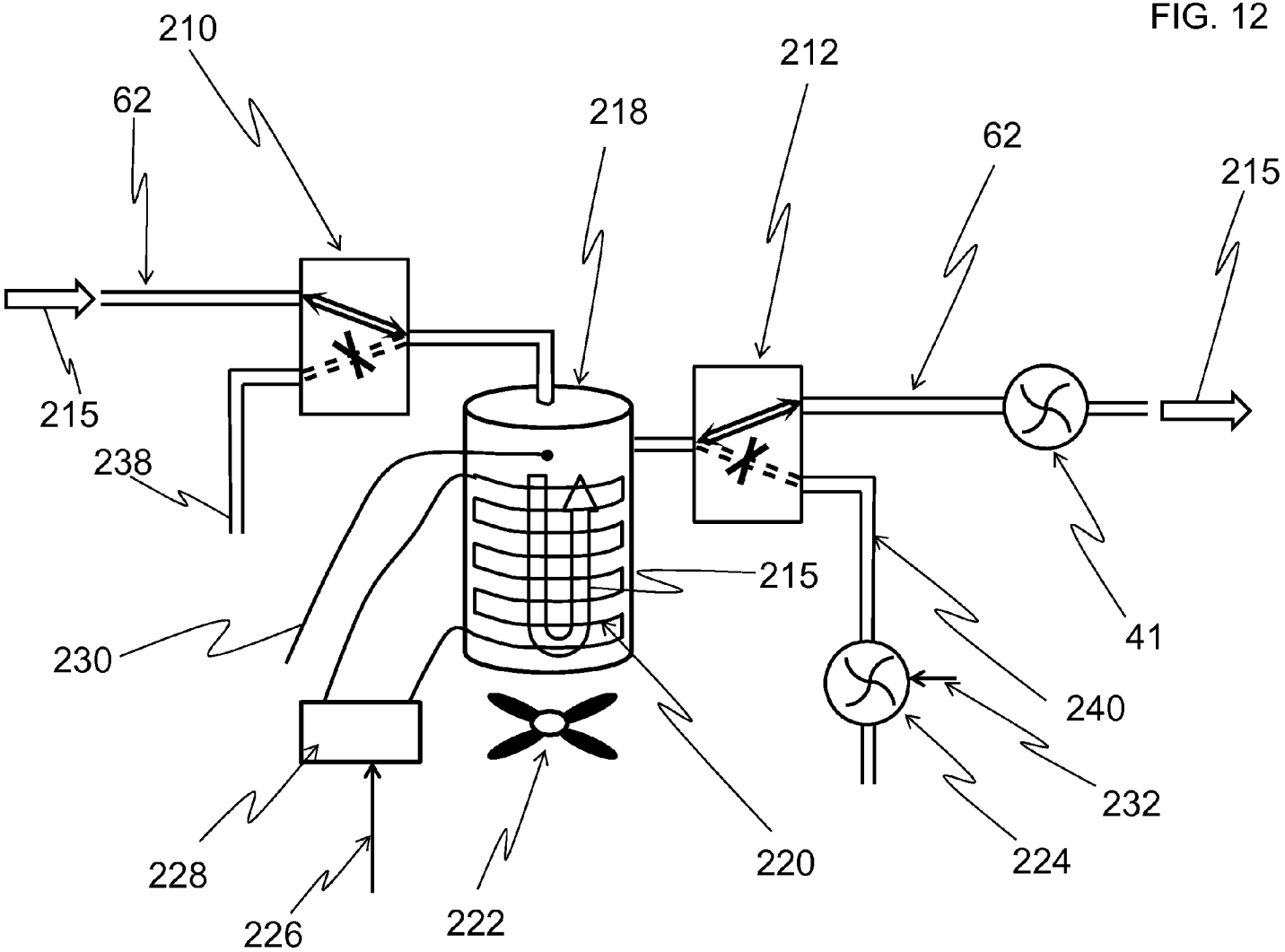
FIG. 12 is a block diagram of a regenerative desiccator depicted with 3-way solenoid valves in the open position to, for example, provide vacuum to an evacuation chamber in the moisture scavenging state according to another embodiment.
Figure 13:
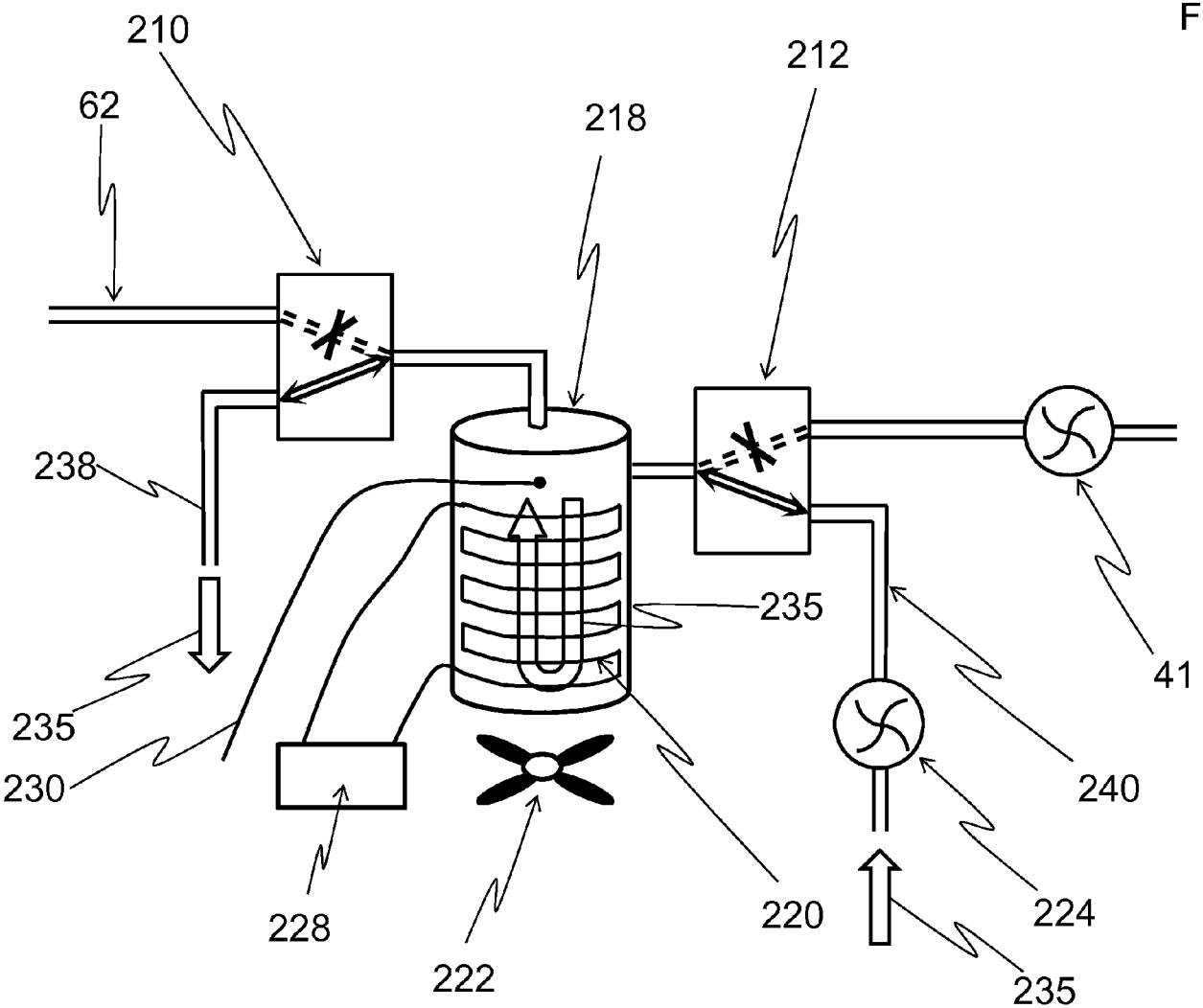
FIG. 13 is a block diagram of the regenerative desiccator of FIG. 12 depicted with 3-way solenoid valves in the closed position to, for example, provide an air purge to the desiccators.

Referring now to FIG. 12, desiccator 218 is shown with a desiccator heater 220, a desiccator temperature sensor 230, a desiccator cooling fan 222, and desiccator air purge solenoid valves 210 and 212. Vacuum pump 41 is connected to evacuation manifold 62 and air purge pump 224 is pneumatically connected to air purge solenoid valve 212 via air purge manifold 240. Three-way air purge solenoid valves 210 and 212 are depicted in the state to enable vacuum through desiccator 218 as shown by air directional path Referring to FIG. 13, desiccator 3-way air purge solenoid valves 210 and 212 are depicted in a maintenance state, which permits air flow from air purge pump 224 flushed "backwards" along direction 235 through desiccator and out via purged air port 238. Air purge pump 224 can cause pressurized air to flow along air directional path 235. This preferred directional path of atmospheric air permits the desiccant to give up moisture in a pneumatically isolated state and prevents moisture from entering air purge pump 224, which would occur if air purge pump were to pull air through desiccator 218. Purge pump 224 can continue to blow air in the directional path 235 for a prescribed time in microprocessor 44 maintenance control algorithm. In one embodiment, an in-line relative humidity sensor similar to relative humidity sensor 61 is incorporated to sense when desiccator 218 is sufficiently dry.

As described above in at least one embodiment, evacuation manifold 62 is disconnected from vacuum pump 41 when desiccator 218 is disconnected from evacuation manifold 62. Nevertheless, alternate embodiments include an evacuation manifold 62 that remains pneumatically connected with vacuum pump 41 when desiccator 218 is disconnected from evacuation manifold 62. This configuration may be useful in situations where desiccator 218 may be blocking airflow, such as when desiccator 218 has malfunctioned, and operation of drying apparatus 200 is still desired.

In some embodiments, all of the above described actions are performed automatically so that a user may simply place an electronic device at the proper location and activate the drying device to have the drying device remove moisture from the electronic device.

Microprocessor 44 can be a microcontroller, general purpose microprocessor, or generally any type of controller that can perform the requisite control functions. Microprocessor 44 can reads its program from memory 45, and may be comprised of one or more components configured as a single unit. Alternatively, when of a multi-component form, processor 44 may have one or more components located remotely relative to the others. One or more components of processor 44 may be of the electronic variety, including digital circuitry, analog circuitry, or both. In one embodiment, processor 44 is of a conventional, integrated circuit microprocessor arrangement, such as one or more CORE i7 HEXA processors from INTEL Corporation (450 Mission College Boulevard, Santa Clara, Calif. 95052, USA), ATHLON or PHENOM processors from Advanced Micro Devices (One AMD Place, Sunnyvale, Calif. 94088, USA), POWER8 processors from IBM Corporation (1 New Orchard Road, Armonk, N.Y. 10504, USA), or PIC Microcontrollers from Microchip Technologies (2355 West Chandler Boulevard, Chandler, Ariz. 85224, USA). In alternative embodiments, one or more application-specific integrated circuits (ASICs), reduced instruction-set computing (RISC) processors, general-purpose microprocessors, programmable logic arrays, or other devices may be used alone or in combination as will occur to those skilled in the art.

Likewise, memory 45 in various embodiments includes one or more types, such as solid-state electronic memory, magnetic memory, or optical memory, just to name a few. By way of non-limiting example, memory 45 can include solid-state electronic Random Access Memory (RAM), Sequentially Accessible Memory (SAM) (such as the First-In, First-Out (FIFO) variety or the Last-In First-Out (LIFO) variety), Programmable Read-Only Memory (PROM), Electrically Programmable Read-Only Memory (EPROM), or Electrically Erasable Programmable Read-Only Memory (EEPROM); an optical disc memory (such as a recordable, rewritable, or read-only DVD or CD-ROM); a magnetically encoded hard drive, floppy disk, tape, or cartridge medium; or a plurality and/or combination of these memory types. Also, memory 45 may be volatile, nonvolatile, or a hybrid combination of volatile and nonvolatile varieties. Memory 45 in various embodiments is encoded with programming instructions executable by processor 44 to perform the automated methods disclosed herein.

Various aspects of different embodiments of the present disclosure are expressed in paragraphs X1, X2, X3, X4, X5, X6, and X7 as follows:

X1. One embodiment of the present disclosure includes an electronic device drying apparatus for drying water damaged or other wetting agent damaged electronics comprising: a heated conduction platen means; a vacuum chamber means; an evacuation pump means; a convection oven means; a solenoid valve control means; a microprocessor controlled system to automatically control heating and evacuation; a vacuum sensor means; a humidity sensor means; and a switch array for algorithm selection.

X2. Another embodiment of the present disclosure includes a method, comprising: placing a portable electronic device that has been rendered at least partially inoperable due to moisture intrusion into a low-pressure chamber; heating the electronic device; decreasing pressure within the low-pressure chamber; removing moisture from the interior of the portable electronic device to the exterior of the portable electronic device; increasing pressure within the low-pressure chamber after said decreasing pressure; equalizing the pressure within the low-pressure chamber with the pressure outside the low-pressure chamber; and removing the portable electronic device from the low-pressure chamber.

X3. Another embodiment of the present disclosure includes an apparatus, comprising: a low-pressure chamber defining an interior, the low-pressure chamber with an interior sized and configured for placement of an electronic device in the interior and removal of an electronic device from the interior; an evacuation pump connected to the chamber; a heater connected to the chamber; and a controller connected to the evacuation pump and to the heater, the controller controlling removal of moisture from the electronic device by controlling the evacuation pump to decrease pressure within the low-pressure chamber and controlling operation of the heater to add heat to the electronic device.

X4. Another embodiment of the present disclosure includes a device for removing moisture from an electronic device, substantially as described herein with reference to the accompanying Figures.

X5. Another embodiment of the present disclosure includes a method of removing moisture from an electronic device, substantially as described herein with reference to the accompanying Figures.

X6. Another embodiment of the present disclosure includes a method of manufacturing a device, substantially as described herein, with reference to the accompanying Figures.

X7. Another embodiment of the present disclosure includes an apparatus, comprising: means for heating an electronic device; means for reducing the pressure within the electronic device; and means for detecting when a sufficient amount of moisture has been removed from the electronic device.

Yet Other Embodiments Include the Features Described in any of the Previous Statements X1, X2, X3, X4, X5, X6, and X7, as Combined with One or More of the Following Aspects:

A regenerative desiccator means to automatically dry desiccant.

A UV germicidal lamp means to disinfect portable electronic devices.

Wherein said heated conduction platen is comprised of a thermofoil heater laminated to metallic conduction platen.

Wherein said heated conduction platen thermofoil heater is between 25 watts and 1000 watts.

Wherein said heated conduction platen utilizes a temperature feedback sensor.

Wherein said heated conduction platen surface area is between 4 square inches and 1500 square inches.

Wherein said heated conduction platen is also used as a convection oven heater to heat the outside of a vacuum chamber.

Wherein said convection oven is used to heat the outside of a vacuum chamber to minimize internal vacuum chamber condensation once vaporization occurs.

Wherein said vacuum chamber is fabricated from a vacuum-rated material such as plastic, metal, or glass.

Wherein said vacuum chamber is constructed in such a manner as to withstand vacuum pressures up to 30 inches of mercury below atmospheric pressure.

Wherein said vacuum chamber volume is between 0.25 liters and 12 liters.

Wherein said evacuation pump provides a minimum vacuum pressure of 19 inches of mercury below atmospheric pressure.

Wherein said solenoid valves has a orifice diameter between 0.025 inches and 1.000 inches.

Wherein said solenoid valve is used to provide a path for atmospheric air to exchange convection oven heated air.

Wherein said microprocessor controller utilizes algorithms stored in memory for controlled vacuum drying.

Wherein said relative humidity sensor is pneumatically connected to vacuum chamber and used to sample relative humidity real time.

Wherein said microprocessor controller utilizes relative humidity maximums and minimums for controlled vacuum drying.

Wherein said microprocessor controller automatically controls the heated conduction temperature, vacuum pressure, and cycle times.

Wherein said microprocessor controller utilizes a pressure sensor, temperature sensor, and relative humidity sensor as feedback for heated vacuum drying.

Wherein said microprocessor controller logs performance data and can transmit over a modem Internet interface.

Wherein said switch array for algorithm selection provides a simplistic method of control.

Wherein said regenerative desiccator is heated by external thermofoil heaters between 25 W and 1000 W.

Wherein said regenerative desiccator utilizes a fan and temperature signal to permit precise closed-loop temperature control to bake desiccant.

Wherein said regenerative desiccator utilizes 3-way pneumatic valves to pneumatically isolate and switch airflow direction and path for purging said desiccator.

Wherein said UV germicidal light emits UV radiation at a wavelength of 254 nm and a power range between 1 W and 250 W to provide adequate UV radiation for disinfecting portable electronic devices.

Wherein said UV germicidal light disinfects portable electronic devices from between 1 minute and 480 minutes.

Wherein said regenerative desiccator is heated from 120° F. to 500° F. in order to provide a drying medium.

Wherein said regenerative desiccator is heated from between 5 minutes and 600 minutes to provide ample drying time.

Wherein said heated conduction platen is heated between 70° F. and 200° F. to re-introduce heat as compensation for the loss due to the latent heat of evaporation loss.

Wherein said microprocessor controller logs performance data and can transmit and receive performance data and software updates wirelessly over a cellular wireless network.

Wherein said microprocessor controller logs performance data and can print results on an Internet Protocol wireless printer or a locally installed printer.

Wherein said placing includes placing the portable electronic device on a platen, and said heating includes heating the platen to at least approximately 110 deg. F. and at most approximately 120 deg. F.

Wherein said decreasing pressure includes decreasing the pressure to at least approximately 28 inches of Hg below the pressure outside the chamber.

Wherein said decreasing pressure includes decreasing the pressure to at least approximately 30 inches of Hg below the pressure outside the chamber.

Wherein said placing includes placing the portable electronic device on a platen, said heating includes heating the platen to at least approximately 110 deg. F. and at most approximately 120 deg. F, and said decreasing pressure includes decreasing the pressure to at least approximately 28 inches of Hg below the pressure outside the chamber.

Wherein said decreasing pressure and increasing pressure are repeated sequentially before said removing the portable electronic device.

Automatically controlling said repeated decreasing pressure and increasing pressure according to at least one predetermined criterion.

Detecting when a sufficient amount of moisture has been removed from the electronic device.

Stopping the repeated decreasing pressure and increasing pressure after said detecting.

Measuring the relative humidity within the chamber.

Increasing pressure in the chamber after the relative humidity has decreased and the rate of decrease of the relative humidity has slowed.

Wherein said decreasing pressure and increasing pressure are repeated sequentially before said removing the portable electronic device.

Wherein said decreasing pressure begins when the relative humidity has increased and the rate of increase of the relative humidity has slowed.

Wherein said repeated decreasing pressure and increasing pressure is stopped once the difference between a sequential relative humidity maximum and relative humidity minimum are within a predetermined tolerance.

Wherein said repeated decreasing pressure and increasing pressure is stopped once the relative humidity within the chamber reaches a predetermined value.

Decreasing pressure within the low-pressure chamber using a pump.

Removing moisture from the gas being drawn from the chamber with a pump prior to the gas reaching the pump.

Wherein said removing moisture includes removing moisture using a desiccator containing desiccant.

Removing moisture from the desiccant.

Isolating the desiccant from the pump prior to said removing moisture from the desiccant.

Reversing the airflow through the desiccator while removing moisture from the desiccant.

Heating the desiccant during said removing moisture from the desiccant.

Wherein said heating includes heating the desiccant to at least 200 deg. F. and at most 300 deg. F.

Wherein said heating includes heating the desiccant to approximately 250 deg. F.

Wherein the controller controls the evacuation pump to decrease pressure within the low-pressure chamber multiple times, and wherein the pressure within the low-pressure chamber increases between successive decreases in pressure.

A humidity sensor connected to the low-pressure chamber and the controller, wherein the controller controls the evacuation pump to at least temporarily stop decreasing pressure within the low-pressure chamber based at least in part on signals received from the humidity sensor.

Wherein the controller controls the evacuation pump to at least temporarily stop decreasing pressure within the low-pressure chamber when the rate at which the relative humidity changes decreases or is approximately zero.

Wherein the controller controls the evacuation pump to begin decreasing pressure within the low-pressure chamber when the rate at which the relative humidity changes decreases or is approximately zero.

Wherein humidity sensor detects maximum and minimum values of relative humidity as the evacuation pump decreases pressure within the low-pressure chamber multiple times, and wherein the controller determines that the device is dry when the difference between successive maximum and minimum relative humidity values is equal to or less than a predetermined value.

A valve connected to the low-pressure chamber and the controller, wherein the pressure within the low-pressure chamber increases between successive decreases in pressure at least in part due to the controller controlling the valve to increase pressure.

Wherein the controller controls the valve to increase pressure within the low-pressure chamber at approximately the same time the controller controls the evacuation pump to stop decreasing pressure within the low-pressure chamber.

Wherein the controller controls the valve to equalize pressure between the interior of the low-pressure chamber and the outside of the low-pressure chamber.

A temperature sensor connected to the heater and the controller, wherein the controller controls the heater to maintain a predetermined temperature based at least in part on signals received from the pressure sensor.

A pressure sensor connected to the low-pressure chamber and the controller, wherein the controller controls the evacuation pump to at least temporarily stop decreasing pressure within the low-pressure chamber based at least in part on signals received from the pressure sensor.

Wherein the heater includes a platen with which the electronic device is in direct contact during removal of moisture from the electronic device.

Disinfecting the electronic device.

A UV lamp for disinfecting the electronic device.

While illustrated examples, representative embodiments and specific forms of the invention have been illustrated and described in detail in the drawings and foregoing description, the same is to be considered as illustrative and not restrictive or limiting. The description of particular features in one embodiment does not imply that those particular features are necessarily limited to that one embodiment. Features of one embodiment may be used in combination with features of other embodiments as would be understood by one of ordinary skill in the art, whether or not explicitly described as such. Exemplary embodiments have been shown and described, and all changes and modifications that come within the spirit of the invention are desired to be protected.

What is claimed is:

1. A method, comprising the acts of:

placing a portable electronic device that has been rendered at least partially inoperable due to moisture intrusion into a low-pressure chamber and onto a heated conduction platen, wherein the heated conduction platen includes a platen in combination with a heater, wherein the portable electronic device is selected from the group consisting of cell phones, digital music players, watches, pagers, cameras, and tablet computers;

heating the portable electronic device;

decreasing pressure within the low-pressure chamber during said heating;

removing moisture from the interior of the portable electronic device to the exterior of the portable electronic device;

equalizing the pressure within the low-pressure chamber with the pressure outside the low-pressure chamber; and removing the portable electronic device from the low-pressure chamber wherein said heating includes controlling the temperature of the heated conduction platen in contact with the electronic device to maintain the temperature of the heated conduction platen at or above approximately 110 deg. F and at or below approximately 120 deg. F, and said decreasing pressure includes decreasing the pressure to approximately 28-30 inches of Hg below the pressure outside the chamber.

2. The method of claim 1, comprising:

increasing pressure within the low-pressure chamber after said decreasing pressure;

wherein said decreasing pressure and increasing pressure are repeated at least once before said equalizing the pressure and said removing the portable electronic device from the low-pressure chamber.

3. The method of claim 2, comprising:

automatically controlling said repeated decreasing pressure and increasing pressure according to at least one predetermined criterion.

4. The method of claim 2, comprising:

detecting when a sufficient amount of moisture has been removed from the electronic device; and stopping the repeated decreasing pressure and increasing pressure after said detecting.

5. The method of claim 2, wherein said increasing pressure includes introducing ambient air into the low-pressure chamber.

6. The method of claim 1, comprising:

measuring the relative humidity within the low-pressure chamber; and increasing pressure after the relative humidity has decreased and the rate of decrease of the relative humidity has slowed.

7. The method of claim 6, comprising:

decreasing pressure within the low-pressure chamber using a pump; and removing moisture from the gas being drawn from the low-pressure chamber with the pump prior to the gas reaching the pump, said removing including absorbing moisture with a desiccant.

8. The method of claim 7, wherein the desiccant is contained in a desiccator and said removing moisture from the gas being drawn from the low-pressure chamber includes directing the airflow through the desiccator in a first direction, the method further comprising:

isolating the desiccant from the pump;

reversing the direction of airflow through the desiccator while removing moisture from the desiccant; and removing moisture from the desiccant after said isolating.

9. The method of claim 1, comprising:

increasing pressure within the low-pressure chamber after said decreasing pressure, said increasing pressure includes introducing ambient air into the low-pressure chamber; and measuring the relative humidity within the low-pressure chamber;

wherein said decreasing pressure and increasing pressure are repeated at least once before said removing the portable electronic device; and wherein said decreasing pressure begins when the relative humidity has increased and the rate of increase of the relative humidity has slowed.

10. The method of claim 9, comprising:

decreasing pressure within the low-pressure chamber using a pump; and removing moisture from the gas being drawn from the low-pressure chamber with the pump prior to the gas reaching the pump, said removing including absorbing moisture with a desiccant.

11. The method of claim 10, wherein the desiccant is contained in a desiccator and said removing moisture from the gas being drawn from the low-pressure chamber includes directing the airflow through the desiccator in a first direction, the method further comprising:

isolating the desiccant from the pump;

reversing the direction of airflow through the desiccator while removing moisture from the desiccant; and removing moisture from the desiccant after said isolating.

12. The method of claim 1, comprising:

increasing pressure within the low-pressure chamber after said decreasing pressure, and measuring the relative humidity within the low-pressure chamber;

wherein said decreasing pressure and increasing pressure are repeated at least once before said removing the portable electronic device; and wherein said repeated decreasing pressure and increasing pressure is stopped once the difference between a sequential relative humidity maximum and relative humidity minimum are within a predetermined tolerance.

13. The method of claim 12, wherein said increasing pressure includes introducing ambient air into the low-pressure chamber.

14. The method of claim 13, comprising:

decreasing pressure within the low-pressure chamber using a pump; and removing moisture from the gas being drawn from the low-pressure chamber with the pump prior to the gas reaching the pump, said removing including absorbing moisture with a desiccant.

15. The method of claim 14, wherein the desiccant is contained in a desiccator and said removing moisture from the gas being drawn from the low-pressure chamber includes directing the airflow through the desiccator in a first direction, the method further comprising:

isolating the desiccant from the pump;

reversing the direction of airflow through the desiccator while removing moisture from the desiccant; and removing moisture from the desiccant after said isolating.

16. The method of claim 1, comprising:

increasing pressure within the low-pressure chamber after said decreasing pressure, said increasing pressure includes introducing ambient air into the low-pressure chamber; and measuring the relative humidity within the low-pressure chamber;

wherein said decreasing pressure and increasing pressure are repeated at least once before said removing the portable electronic device; and wherein said repeated decreasing pressure and increasing pressure is stopped once the relative humidity within the chamber reaches a predetermined value.

17. The method of claim 16, comprising:

decreasing pressure within the low-pressure chamber using a pump; and removing moisture from the gas being drawn from the low-pressure chamber with the pump prior to the gas reaching the pump, said removing including absorbing moisture with a desiccant.

18. The method of claim 17, wherein the desiccant is contained in a desiccator and said act of removing moisture from the gas being drawn from the low-pressure chamber includes directing the airflow through the desiccator in a first direction, the method further comprising:

isolating the desiccant from the pump;

reversing the direction of airflow through the desiccator while removing moisture from the desiccant; and removing moisture from the desiccant after said isolating.

19. The method of claim 1, comprising:

decreasing pressure within the low-pressure chamber using a pump; and removing moisture from the gas being drawn from the chamber with the pump prior to the gas reaching the pump.

20. The method of claim 19, wherein said removing moisture from the gas being drawn from chamber includes absorbing moisture with a desiccant, the method further comprising:

removing moisture from the desiccant.

21. The method of claim 20, comprising:

isolating the desiccant from the pump prior to said removing moisture from the desiccant.

22. The method of claim 20, wherein the desiccant is contained in a desiccator, and wherein said removing moisture from the gas being drawn from the chamber includes directing the airflow through the desiccator in a first direction, the method further comprising:

reversing the direction of airflow through the desiccator while removing moisture from the desiccant.

23. The method of claim 20, wherein said removing moisture from the desiccant includes heating the desiccant to approximately 250 deg. F.

24. The method of claim 1, comprising:

disinfecting the electronic device.

25. The method of claim 1, comprising:

detecting when a sufficient amount of moisture has been removed from the electronic device.

26. The method of claim 1, comprising:

adding heat to the low-pressure chamber with the heated conduction platen in contact with the electronic device.

27. A method for removing moisture from the interior of a portable electronic device, comprising the acts of:

providing a low-pressure chamber having a heated conduction platen arranged therewithin;

providing a desiccator in fluid communication with the chamber and the desiccator;

providing a pump in fluid communication with the chamber;

placing upon said heated conduction platen the portable electronic device that has been rendered at least partially inoperable due to moisture intrusion, the portable electronic device being selected form the group consisting of cell phones, digital music players, watches, pagers, cameras, and tablet computers;

heating the electronic device conductively by heating said heated conduction platen;

controlling the heating of said heated conduction platen to maintain the temperature of the heated conduction platen within a range of about 110 degrees F. to about 120 degrees F.;

decreasing pressure within the chamber during said heating by drawing gas from within the chamber using said pump to approximately 28-30 inches of Hg below the pressure outside of said chamber;

removing moisture from the gas flow being drawn from within the chamber prior to the gas flow reaching said pump by directing said gas flow through said desiccator in a first direction;

removing moisture from the interior of the portable electronic device to the exterior of the portable electronic device;

increasing pressure within the chamber after said decreasing pressure, said increasing pressure including introducing ambient air into the low-pressure chamber;

measuring the relative humidity within the chamber;

equalizing the pressure within the chamber with the pressure outside of said chamber; and decreasing pressure and increasing pressure within the chamber a least once until the difference between a sequential relative humidity maximum and relative humidity minimum are within a predetermined tolerance.

28. The method of claim 27, comprising:

isolating the desiccant from the pump; and removing moisture from the desiccant after said isolating.

29. The method of claim 28, comprising:

reversing the direction of airflow through the desiccator during said removing moisture from the desiccant.

30. The method of claim 27, wherein the heated conduction platen includes a platen in combination with a heater.

* * * * *